US012185779B2

(12) United States Patent
Andre

(10) Patent No.: US 12,185,779 B2
(45) Date of Patent: Jan. 7, 2025

(54) MEN'S AND WOMEN'S ACTIVEWEAR

(71) Applicant: Samantha Andre, Bethlehem, PA (US)

(72) Inventor: Samantha Andre, Bethlehem, PA (US)

( * ) Notice: Subject to any disclaimer, the term of this patent is extended or adjusted under 35 U.S.C. 154(b) by 110 days.

(21) Appl. No.: 17/503,808

(22) Filed: Oct. 18, 2021

(65) Prior Publication Data

US 2022/0104570 A1 Apr. 7, 2022

Related U.S. Application Data

(60) Division of application No. 15/672,284, filed on Aug. 8, 2017, now Pat. No. 11,147,327, which is a continuation-in-part of application No. 29/491,516, filed on May 21, 2014, now abandoned.

(51) Int. Cl.

| | |
|---|---|
| ***A41D 31/18*** | (2019.01) |
| ***A41D 13/00*** | (2006.01) |
| ***A41D 13/05*** | (2006.01) |
| ***A41D 31/00*** | (2019.01) |
| ***A41D 31/12*** | (2019.01) |

(52) U.S. Cl.

CPC ..... *A41D 31/18* (2019.02); *A41D 13/0017* (2013.01); *A41D 13/0518* (2013.01); *A41D 13/0525* (2013.01); *A41D 13/0562* (2013.01); *A41D 31/00* (2013.01); *A41D 31/0005* (2013.01); *A41D 31/12* (2019.02); *A41D 13/0015* (2013.01); *A41D 2400/10* (2013.01); *A41D 2400/36* (2013.01); *A41D 2400/38* (2013.01); *A41D 2500/10* (2013.01)

(58) Field of Classification Search

CPC ..... A41D 13/0017; A41D 13/0018; A41D 13/0518; A41D 13/0525; A41D 13/0562; A41D 13/0015; A41D 31/18; A41C 1/06

See application file for complete search history.

(56) References Cited

U.S. PATENT DOCUMENTS

| | | | | |
|---|---|---|---|---|
| 5,551,085 A * | 9/1996 | Leighton | A61F 5/028 602/19 |
| 11,147,327 B2 * | 10/2021 | Andre | A41D 13/0525 |
| 2017/0143047 A1 * | 5/2017 | Howard | A41D 13/0525 |

* cited by examiner

*Primary Examiner* — Katherine M Moran

(57) ABSTRACT

The Active Wear Exercise Garment, for men and women, can be worn alone or under clothing, and has various features. The Top section, which supports the breast and chest area, is constructed with fabric that has a plurality of densities with integrated elasticity, such as LYCRA®, spandex, or knit fabric. The Mid to Lower Top section, the Pant section, and the abdomen Wrap are constructed with a four way multi-functional fabric, such as neoprene or similar fabric, and provides multiple benefits to the wearer all at once. These benefits include water weight loss, moisture management, body support, odor control, comfort, and flexibility. The Side Panels have the same fabric as the Top section such as LYCRA®, spandex, or knit fabric, and provides extra support, ease of ingress and egress of the garment, room for the body to decrease or expand, extra breathability so that the body does not overheat, extra comfort and flexibility, provides moisture wicking and quick drying support, and extends from the under arm section to the bottom of the garment.

15 Claims, 28 Drawing Sheets

MEN'S AND WOMEN'S ACTIVEWEAR

RELATED APPLICATIONS

This application is a divisional of U.S. application Ser. No. 15/672,284, filed on Aug. 8, 2017, now U.S. Pat. No. 11,147,327, issued on Oct. 19, 2021, which claims the benefit of U.S. application Ser. No. 29/491,516, filed on May 21, 2014, and the entirety of these applications are hereby incorporated by reference for the teachings therein.

BACKGROUND OF THE INVENTION

Both men and women wear form fitting workout apparel with LYCRA® fabric to give them comfortable range of movement. Apparel using neoprene fabric to accelerate water weight loss while performing low and high impact physical activities are also used by men and women to aid in weight loss. Neoprene fabric is also used in waist wraps to give lower back support to the wearer and aid in weight loss.

There are various garments that have the water weight loss and moisture wicking features but have not resolved the deficiencies. (Sawka, et al., 1998.) Sawka, et al. concluded that protective clothing usually causes a sweating rate of 1 to 2 liters per hour if the wearer is performing light intensity exercise.

Dicker, et. al. entitled "Aerobic Exercise Garment" received U.S. Pat. No. 6,231,488 on May 15, 2001 for an aerobic resistance garment designed for indoor, warm weather, or high temperature use by including elastic resistance bands and breathable base fabric such as an open mesh or net material with a partial bare midriff shown, if preferred. There are a few garments that have fabric with elasticity to provide resistance to various movements of the body in low and high impact activities such as apparel found in U.S. Pat. Nos. 5,109,546, 5,176,600, 5,186,701, 5,201,074, 5,306,222 and 5,570,472.

The present invention relates to some manufacturing techniques in the following U.S. Pat. Nos. 8,376,808 B2, 5,109,546, 5, 176,600, 5,186,701, 5,201,074, 5,306,222 and 5,570,472 and 5,570,472, and to U.S. patent application Ser. No. 08/627,426 filed Apr. 4, 1996; Ser. No. 08/660,098, filed Jun. 6, 1996; Ser. No. 08/734,736, filed Oct. 21, 1996; Ser. No. 08/761,290, fled Dec. 6, 1996; Ser. No. 08/777,453, fled Dec. 3, 1996; Ser. No. 08/802,972, filed Feb. 20, 1997; Ser. No. 08/802,973, filed Feb. 20, 1997; Ser. No. 08/834,887, filed Apr. 7, 1997; Ser. No. 08/840,917, filed Apr. 25, 1997; Ser. No. 08/880,715, filed Jun. 23, 1997; Ser. No. 08/892, 669, filed Jul. 14, 1997, and Ser. No. 08/986,521, filed Dec. 8, 1997, all of the information is combined herein with reference thereto. These patents and applications illustrate the general garments to which manufacturing techniques maybe applied for making garments in accordance with this invention.

There are many deficiencies found in the aforementioned garments, sauna and sweat suits such as:

1) Not form fitting; loose-fitting and shapeless which makes the garment uncomfortable to wear under regular clothes and difficult to conceal.
2) Not designed to absorb and dry the heavy sweat that saturates the suits so the suits are damaged, reducing the garment's quality of life. Plus the wearer's clothing, undergarments and footwear may get wet or stained from the sweat.
3) Designed to be unisex and or one size fits all.

4) The wearer needs to wear a bra or undergarments under the suits to support the breast and chest area.

There are garments that have integrated a sports bra and sauna suit to remedy the deficiencies however other deficiencies exist such as:

1) It is difficult to get in and out of the garment.
2) The fabric which promotes water weight loss—neoprene or similar fabric—eventually takes the form of the wearer's body and loosens, and in some cases the garment over time becomes saggy and no longer form fitting.
3) There are very little or no extra ventilation sections to ensure that the wearer does not overheat due to extreme exercise or climate conditions. Plus the garment doesn't dry easily.
4) There are no Waist Wraps promoting water weight loss and back support that are attached directly to the garment. And Waist Wraps that are not attached directly to the garment are flimsy and are not adequately secured around the wearer's waist which causes the wearer to constantly adjust the Wrap during low and high impact activities.
5) The sports bra which supports the breast can be restrictive and uncomfortable to the wearer.

These deficiencies have not been remedied with a single integrated solution. Accordingly, it has been recognized that there's a significant need for an exercise garment which resolves these deficiencies. The present invention resolves these issues.

SUMMARY OF THE INVENTION

The Active Wear Exercise Garment is form fitting apparel for both Men and Women with 5 main sections. The Top section of the garment supports the breast and chest area and is constructed with fabric that has a plurality of densities with integrated elasticity, such as LYCRA®, spandex, or knit fabric, and wicking or quick drying properties. The garment can be worn alone or under clothes and has multiple designs such as tops, pants, all in one suits, and the abdomen Wrap attached to the waist of the garment. The aforementioned deficiencies have been remedied by the present invention by incorporating the side panels, non-restrictive Top section, and the abdomen wrap.

The Side Panels of the garment has what no other similar garment has thus making this design and functionality unique. The side panels of the garment is constructed with fabric that has a plurality of densities with integrated elasticity, such as LYCRA®, spandex, or knit fabric, and wicking or quick drying properties. The side panels provide the wearer with the following benefits:

1) Ease of Ingress and Egress—putting on and taking off the garment is made easier.
2) Extends Product Quality—other garments do not include the side panels so after time, the mid-section which is initially fitted, eventually conforms to the wearers body and becomes loose and no longer form fitting. The elasticity of the side panels stretches, therefore, decreasing the chances of the mid-section from stretching out of shape and loosening. Other similar garments do not have this unique feature.
3) Flexibility—the side panels allow the wearer the flexibility for their body to reasonably decrease or increase in size without drastically loosening the fit of the garment, instead, the garment conforms to the wearer's body comfortably. With other garments there is no flexibility to lose or gain weight so the product conforms to the initial size of the wearer and isn't flexible, therefore, the garment becomes stretched out if the wearer loses or gains weight. The side panels also provides extra support and flexibility for the wearer with their range of motion during low to high impact activities.

4) Ventilation—the side panels provides additional ventilation so that the body does not overheat. The side panels extends from the under arm section to the bottom of the garment of the tops and all in one suits. For the pants the side panels extends from the waist to the bottom of the pants.

5) Moisture Management—in addition to the side panels providing ventilation, the fabric used will have wicking properties so that it wicks sweat away from the wearer's body and aids in drying the garment.

Another unique feature is the abdomen Wrap which is secured around the waste using Velcro patches. The wrap is unique in that it resolves the deficiencies of similar products. Other products have fasteners or closures that don't allow the wearer to have complete flexibility to move comfortably without having to constantly adjust the wrap around their waist. This invention resolves that deficiency by applying Velcro patches to the right and left of the wrap, and mid to lower back of the wrap and garment. The position of the Velcro patches on the garment and Wrap secures the Wrap so that it does not move and the wearer does not have to constantly adjust the Wrap during their physical activities. The issue of the Wrap loosening up during physical activities is resolved. The Wrap is positioned under the breast area and extends to the length of the top, and above the hip and thigh section of the pants and all in one designs. The length and width of the wrap will differ depending on the size and style variations. The Wrap is made of neoprene or similar fabric, which provides multiple benefits to the wearer all at once. The weight of the neoprene or similar fabric will differ depending on the variations in design. The main benefits to the wearer includes:

i. Water Weight Loss—the fabric generates body heat while the wearer exercises or performs low impact to high impact activities. This aids in water weight loss. This invention will have variations which will include both breathable and non-breathable neoprene, or similar fabric.

ii. Moisture Management—the breathable fabric will aid in wicking away moisture from the body and aid in drying the fabric.

iii. Body Support—the fabric supports and hugs the body and provides support for the abdominal region, and extra support for the lower back region of the wearer. The weight of the neoprene or similar fabric will vary.

iv. Odor Control—the fabric also neutralizes and controls Odor.

v. Comfort and Flexibility—the fabric provides comfort and support to the wearer when performing exercise activities (low and high impact).

The Top section is not restrictive and uncomfortable like a Sports Bra but the fabric has the elasticity and density to support the breast during low and high impact activities so the wearer does not have to wear a bra.

The mid and lower section of the Top section extends from under the breast and chest area to the top to mid hip section of the wearer. The length of the Top depends on the style variations and the size. The mid and lower section of the pant and All in One suits extends from under the breast and chest area, covers the abdomen area, and ends at the bottom of the pant. The length of the pant will vary. This section of the garment is constructed with a four way multi-functional fabric, such as neoprene or similar fabric, which provides multiple benefits to the wearer all at once. The weight of the neoprene or similar fabric will vary depending on the variations in design. The main benefits to the wearer includes:

i. Water Weight Loss—the fabric generates body heat while the wearer exercises or performs low impact to high impact activities. This aids in water weight loss. This invention will have variations which will include both breathable and non-breathable neoprene, or similar fabric.

ii. Moisture Management—the fabric will aid in wicking away moisture from the body and aid in drying the fabric. The non-breathable fabric will dry aided by the side panels in the design.

iii. Body Support—the fabric supports and hugs the body and provides support for the abdominal region, back, and lower back regions of the wearer for the tops, pants and all in one suits. And for the pants and all in one suits the fabric provides additional support to the hips, thighs and legs of the wearer.

iv. Odor Control—the fabric also neutralizes and controls Odor.

v. Comfort and Flexibility—the fabric provides comfort and support to the wearer when performing exercise activities (low and high impact).

Variations

There are many possible variations of this product but the side panels will be the unique feature which will be in all of the designs thus making the garment unique and eliminating the deficiencies found in similar products. The different variations include pants, both long and short, and body suits. The pants versions will have various lengths which will end either at the knee, mid-calf, thigh, hip or ankle. The designs will include the side panels from the waist to the length of the pants. The water weight loss fabric, neoprene or similar fabric will be in the abdomen area both back and front. The leg, hip and thigh sections will also include the water weight loss fabric, neoprene or similar fabric, in both the back and front panels of the pant legs. Another variation is a body suit which would integrate the Top section of the garment as described above, and pants; both long and short, as described above. And a regular body suit which does not include pants but have openings for the legs and cover the breast, abdomen, and hip areas (not shown). Another variation includes different Top sections and mid-section designs, with various sleeve lengths (not shown). All Tops and variations will have the unique side panel design as aforementioned. All variations are not limited to what is listed above but will include the unique feature of the side panels. Another variation will include pockets on various garments both inside and outside (not shown). The pockets will have various shapes and sizes and made of various fabrics such as LYCRA®, spandex, or knit fabric or constructed with a four way multi-functional fabric, such as neoprene or similar fabric. The pockets will hold various items such as keys, cellular phones, money, drink bottles, etc. All variations of the pockets are not limited to what is listed above.

DETAILED DESCRIPTION

Figure 1:
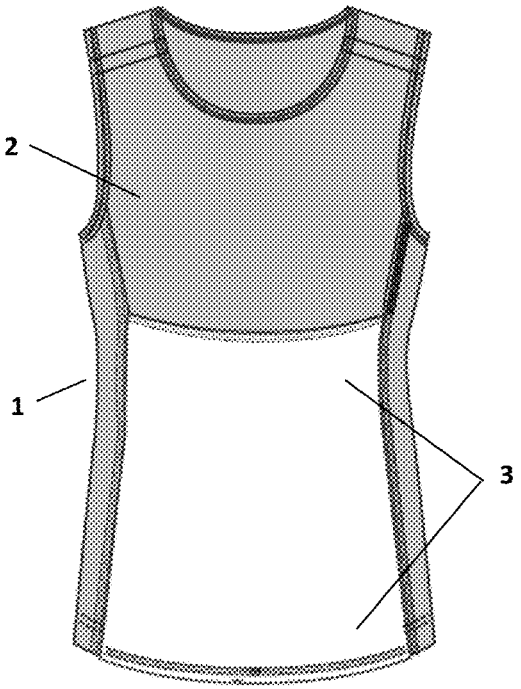
FIG. 1 illustrates a Front elevation view of the Men's Active Wear Exercise Top, according to the first embodiment.

FIG. 1 is a Front elevation view of the Men's Active Wear Exercise Top, according to the first embodiment.

Element 1 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel is seen in the back view of the garment as in Element 4. The Side Panels are constructed with fabric that has a plurality of densities with integrated elasticity, such as LYCRA®, spandex, or knit fabric.

Element 2 is a Front elevation view of the Top Section which supports the breast chest area and is constructed with fabric that has a plurality of densities with integrated elasticity, such as LYCRA®, spandex, or knit fabric thereof.

Element 3 is a Front elevation view of the mid and lower section of the top which covers the abdomen. This section extends from under the breast and chest area to the top to mid hip section of the wearer (length will vary). This section of the garment is constructed with a four way multi-functional fabric, such as neoprene or similar fabric.

Figure 2:
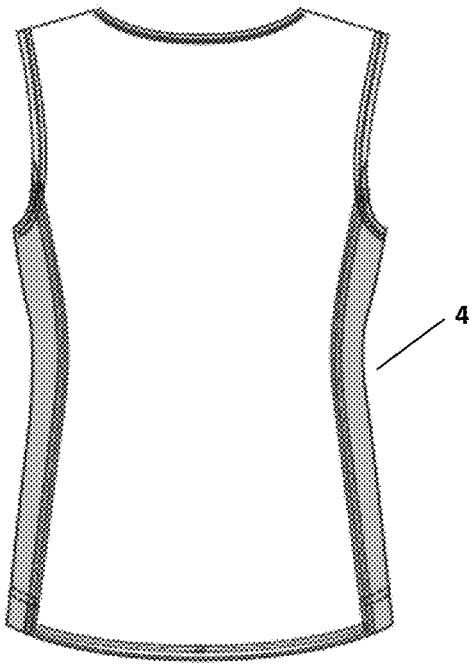
FIG. 2 is a Rear elevation view and is constructed with a four way multi-functional fabric according to an embodiment.

FIG. 2 is a Rear elevation view and is constructed with a four way multi-functional fabric, such as neoprene or similar fabric, or with fabric that has a plurality of densities with integrated elasticity, such as LYCRA®, spandex, or knit fabric, or both fabrics thereof.

Element 4 is a Rear elevation view of the Side Panels thereof.

Element 5 is a Side elevation view of the Side Panels thereof.

Figure 3:
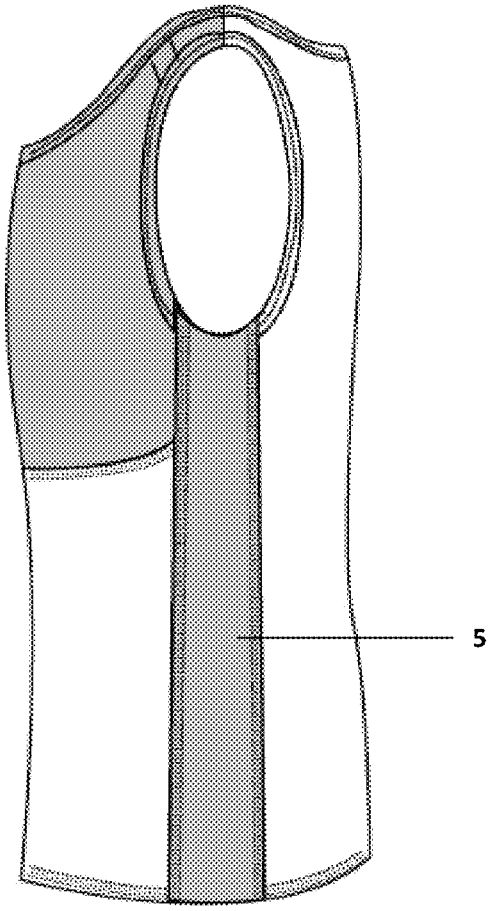
FIG. 3 is a Side elevation view of the Top thereof, according to an embodiment.

FIG. 3 is a Side elevation view of the Top thereof.

Figure 4:
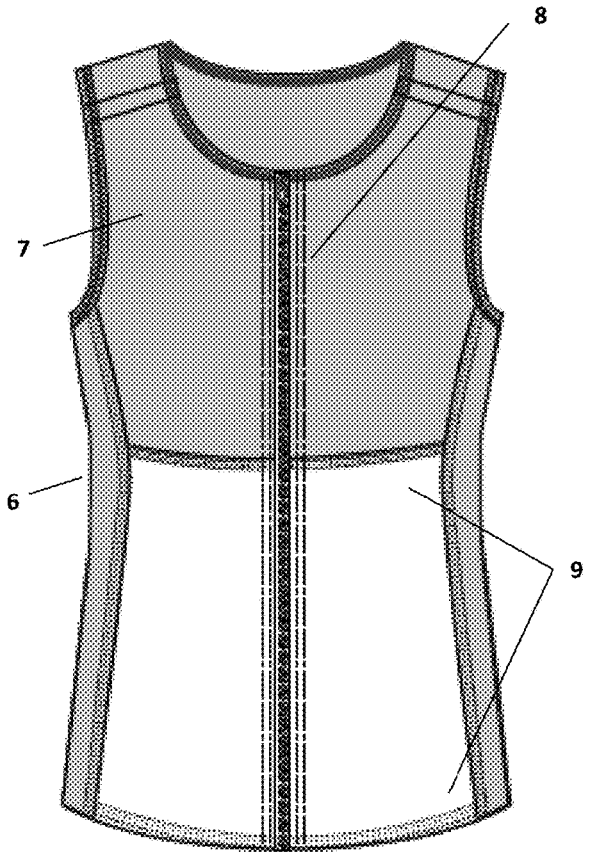
FIG. 4 is a Front elevation view of the Men's Active Wear Exercise Top with a Front Zipper, according to the second embodiment.

FIG. 4 is a Front elevation view of the Men's Active Wear Exercise Top with a Front Zipper, according to the second embodiment.

Element 6 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 10. The Side Panels are constructed with fabric that has a plurality of densities with integrated elasticity, such as LYCRA®, spandex, or knit fabric.

Element 7 is a Front elevation view of the Top Section which supports the breast chest area and is constructed with fabric that has a plurality of densities with integrated elasticity, such as LYCRA®, spandex, or knit fabric thereof.

Element 8 is a Front elevation view of the Zipper thereof.

Element 9 is a Front elevation view of the mid and lower section of the top which covers the abdomen. This section extends from under the breast and chest area to the top to mid hip section of the wearer (length will vary). This section of the garment is constructed with a four way multi-functional fabric, such as neoprene or similar fabric.

Figure 5:
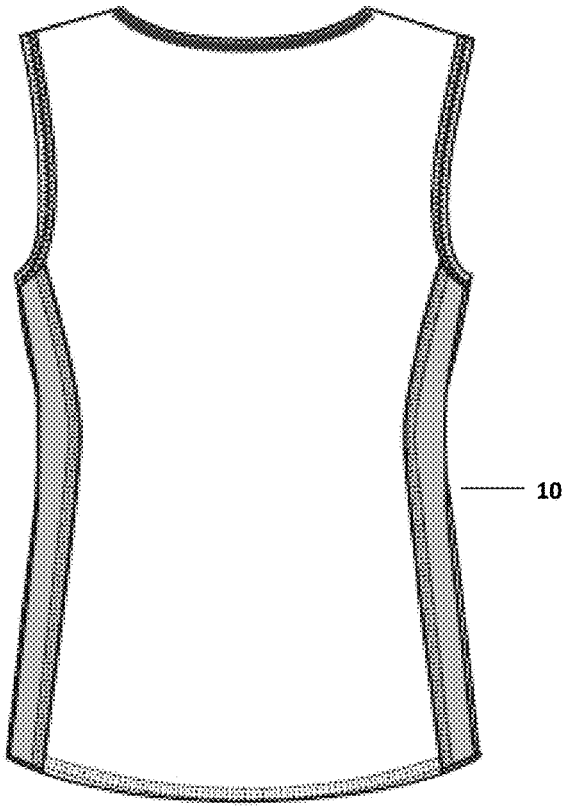
FIG. 5 is a Rear elevation view and is constructed with a four way multi-functional fabric, according to an embodiment.

FIG. 5 is a Rear elevation view and is constructed with a four way multi-functional fabric, such as neoprene or similar fabric, or with fabric that has a plurality of densities with integrated elasticity, such as LYCRA®, spandex, or knit fabric, or both fabrics thereof.

Element 10 is a Rear elevation view of the Side Panels thereof.

Element 11 is a Side elevation view of the Side Panels thereof.

Figure 6:
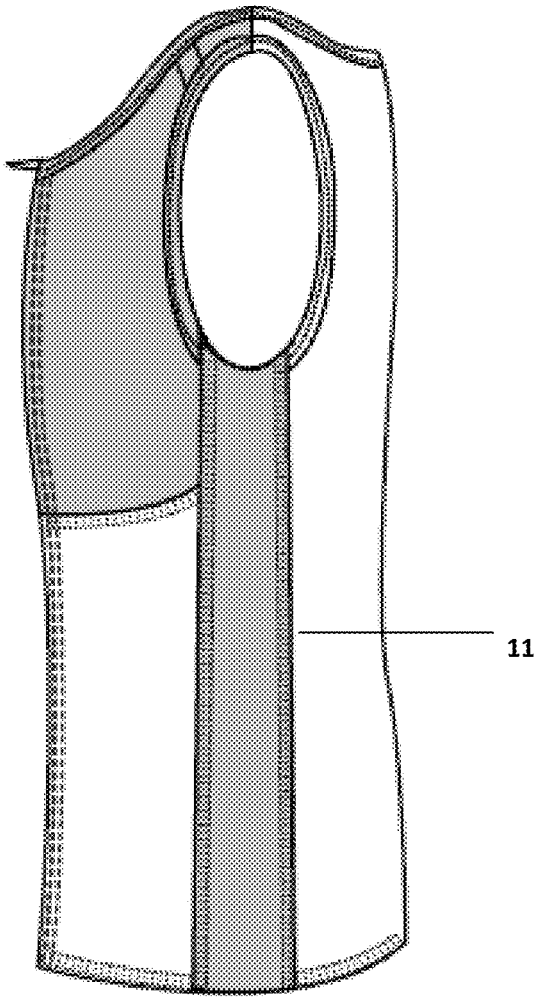
FIG. 6 is a Side elevation view of the Top thereof, according to an embodiment.

FIG. 6 is a Side elevation view of the Top thereof.

Figure 7:
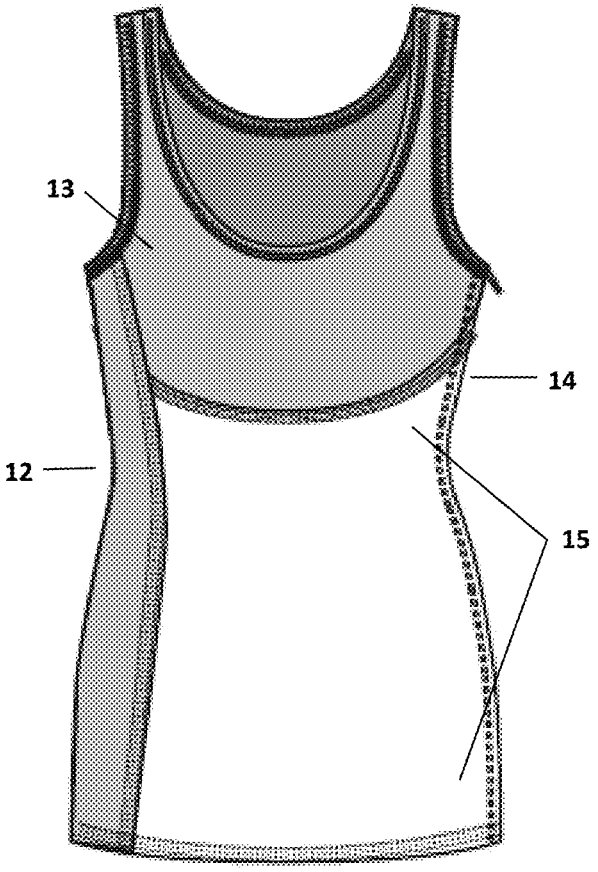
FIG. 7 is a Front elevation view of the Women's Active Wear Exercise Top with Side Zipper, according to the third embodiment.

FIG. 7 is a Front elevation view of the Women's Active Wear Exercise Top with Side Zipper, according to the third embodiment.

Element 12 is a Front elevation view of the Side Panels on the left side thereof. the side panel is inserted to connect the front and back of the garment The side panel is approximately 4 to 6 inches in width. About 2 to 3 inches of the left side panel as seen in the front view and, about 0.2 to 3 inches of the left side panel is seen in the back view of the garment as in Element 16. The Side Panel is constructed with fabric that has a plurality of densities with integrated elasticity, such as LYCRA®, spandex. or knit fabric.

Element 13 is a Front elevation view of the Top Section which supports the breast chest area and is constructed with fabric that has a plurality of densities with integrated elasticity, such as LYCRA®, spandex, or knit fabric thereof.

Element 14 is a Front elevation view of the Side Zipper on the right side thereof.

Element 15 Is a Front elevation view of the mid and lower section of the top which covers the abdomen. This section extends from under the breast and chest area to the top to mid hip section of the wearer (length will vary). This section of the garment is constructed with a four way multi-functional fabric, such as neoprene or similar fabric.

Figure 8:
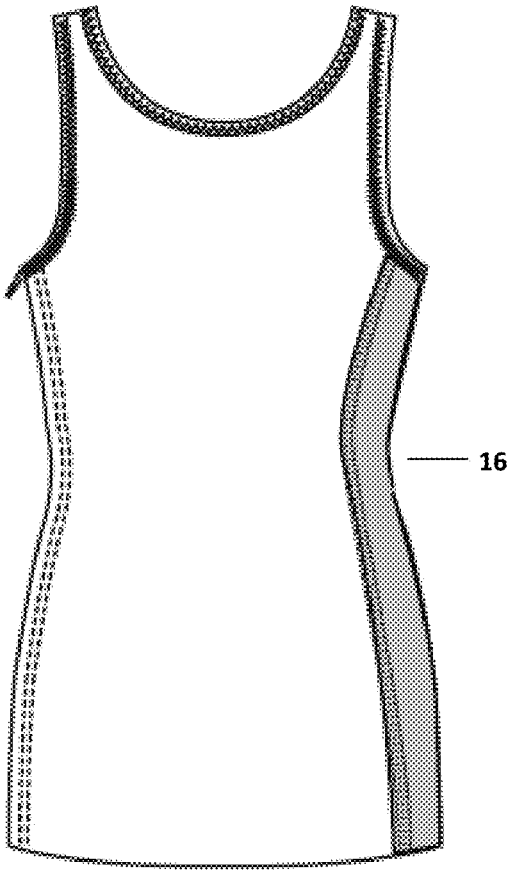
FIG. 8 is a Rear elevation view and is constructed with a four way multi-functional fabric, according to an embodiment.

FIG. 8 is a Rear elevation view and is constructed with a four way multi-functional fabric, such as neoprene or similar fabric, or with fabric that has a plurality of densities with integrated elasticity, such as LYCRA®, spandex, or knit fabric, or both fabrics thereof.

Element 16 is a Rear elevation view of the Side Pane! thereof.

Element 17 is a Side elevation view of the Side Panels thereof.

Element 18 is a Side elevation view of the Side Zipper thereof.

Figure 9:
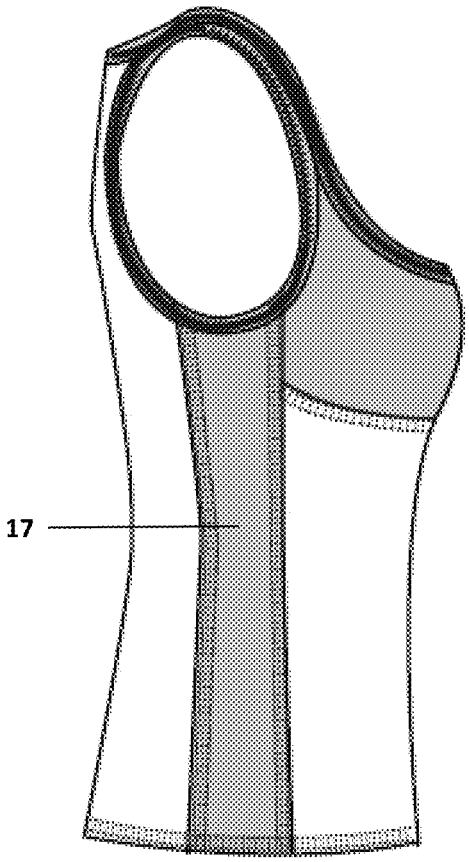
FIG. 9 is the left Side elevation view of the Top with the Side Panel, according to an embodiment.

FIG. 9 is the left Side elevation view of the Top with the Side Panel.

Figure 10:
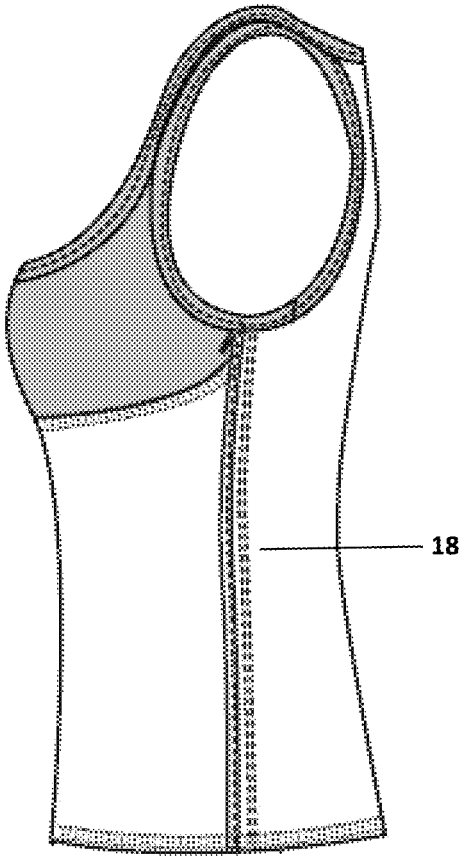
FIG. 10 is the right Side elevation view of the Top and Side Zipper thereof, according to an embodiment.

FIG. 10 is the right Side elevation view of the Top and Side Zipper thereof.

Figure 11:
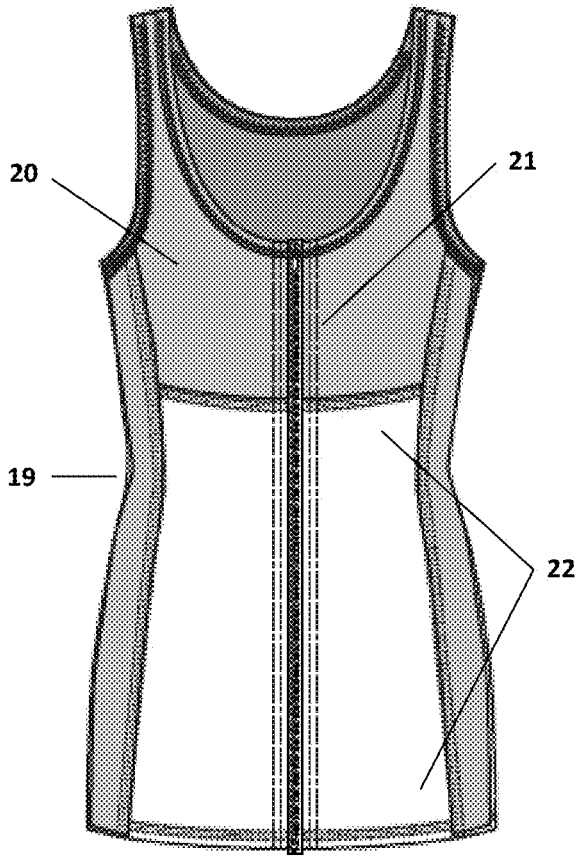
FIG. 11 is a Front elevation view of the Women's Active Wear Exercise Top with Front Zipper, according to the fourth embodiment.

FIG. 11 is a Front elevation view of the Women's Active Wear Exercise Top with Front Zipper, according to the fourth embodiment.

Element 19 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 23. The Side Panels are constructed with fabric that has a plurality of densities with integrated elasticity, such as LYCRA®, spandex, or knit fabric.

Element 20 is a Front elevation view of the Top Section which supports the breast chest area and is constructed with fabric that has a plurality of densities with integrated elasticity, such as LYCRA®, spandex, or knit fabric thereof.

Element 21 is a Front elevation view of the Front Zipper thereof.

Element 22 is a Front elevation view of the mid and lower section of the top which covers the abdomen. This section extends from under the breast and chest area to the top to mid hip section of the wearer (length will vary). This section of the garment is constructed with a four way multi-functional fabric, such as neoprene or similar fabric.

Figure 12:
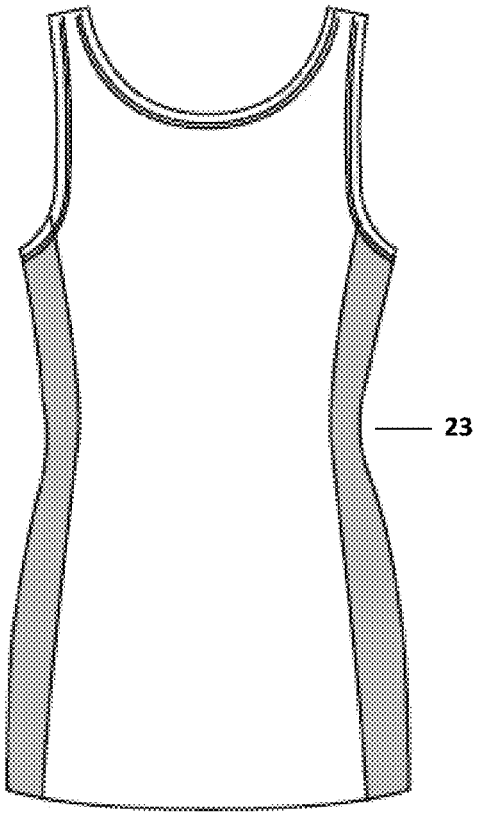
FIG. 12 is a Rear elevation view and is constructed with a four way multi-functional fabric, according to an embodiment.

FIG. 12 is a Rear elevation view and is constructed with a four way multi-functional fabric, such as neoprene or similar fabric, or with fabric that has a plurality of densities with integrated elasticity, such as LYCRA®, spandex, or knit fabric, or both fabrics thereof.

Element 23 is a Rear view elevation view of the Side Panels thereof.

Element 24 is a Side elevation view of the Side Panels thereof.

Figure 13:
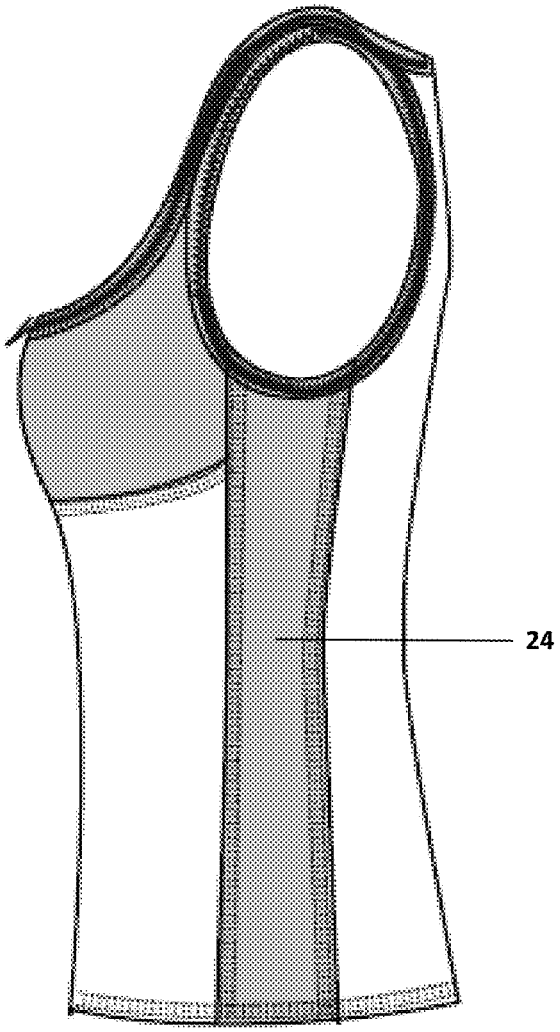
FIG. 13 is a Side elevation view of the Top thereof, according to an embodiment.

FIG. 13 is a Side elevation view of the Top thereof.

Figure 14:
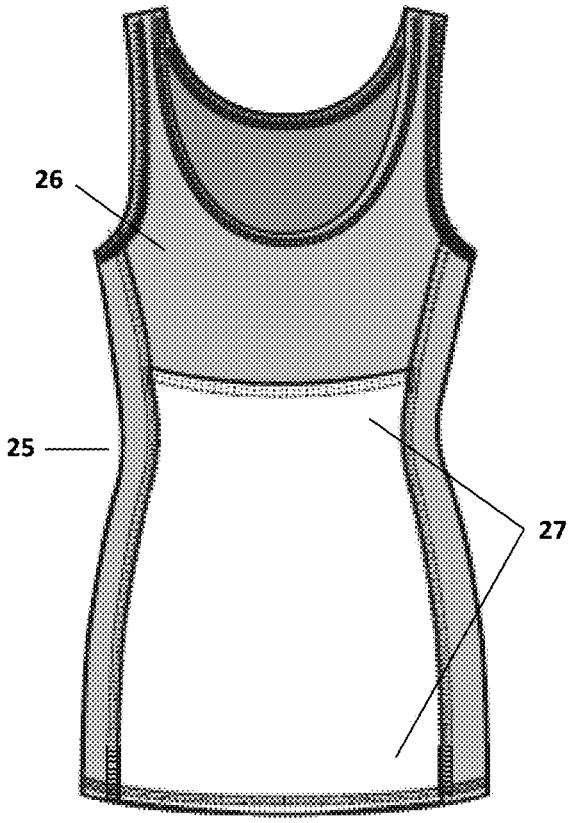
FIG. 14 is a Front elevation view of the Women's Active Wear Exercise Top, according to the fifth embodiment.

FIG. 14 is a Front elevation view of the Women's Active Wear Exercise Top, according to the fifth embodiment.

Element 25 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 28. The Side Panels are constructed with fabric that has a plurality of densities with integrated elasticity, such as LYCRA®, spandex, or knit fabric.

Element 26 is a Front elevation view of the Top Section which supports the breast chest area and is constructed with fabric that has a plurality of densities with integrated elasticity, such as LYCRA®, spandex, or knit fabric thereof.

Element 27 is a Front elevation view of the mid and lower section of the top which covers the abdomen. This section extends from under the breast and chest area to the top to mid hip section of the wearer (length will vary). This section of the garment is constructed with a four way multi-functional fabric, such as neoprene or similar fabric.

Figure 15:
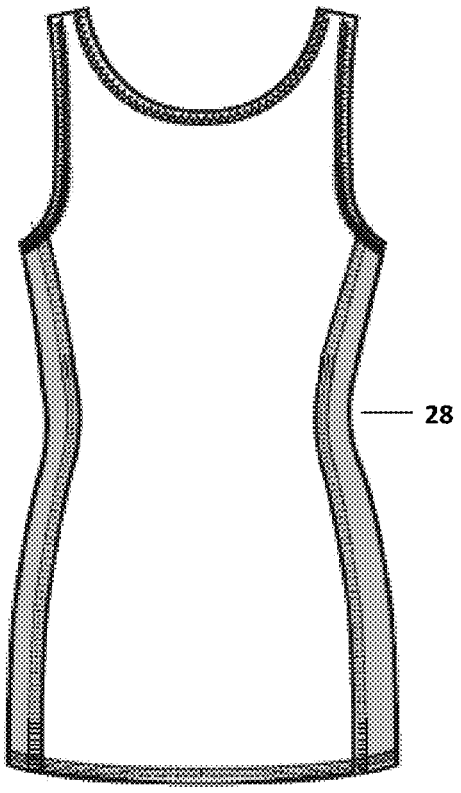
FIG. 15 is a Rear elevation view and is constructed with a four way multi-functional fabric according to an embodiment.

FIG. 15 is a Rear elevation view and is constructed with a four way multi-functional fabric, such as neoprene or similar fabric, or with fabric that has a plurality of densities with integrated elasticity, such as LYCRA®, spandex, or knit fabric, or both fabrics thereof.

Element 28 is a Rear elevation view of the Side Panels thereof.

Element 29 is a Side elevation view of the Side Panels thereof.

Figure 16:
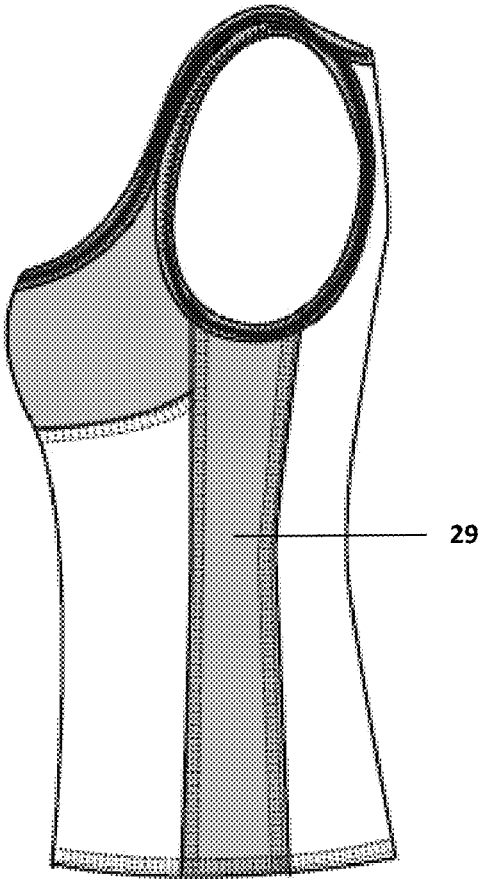
FIG. 16 is a Side elevation view of the Top thereof, according to an embodiment.

FIG. 16 is a Side elevation view of the Top thereof.

Figure 17:
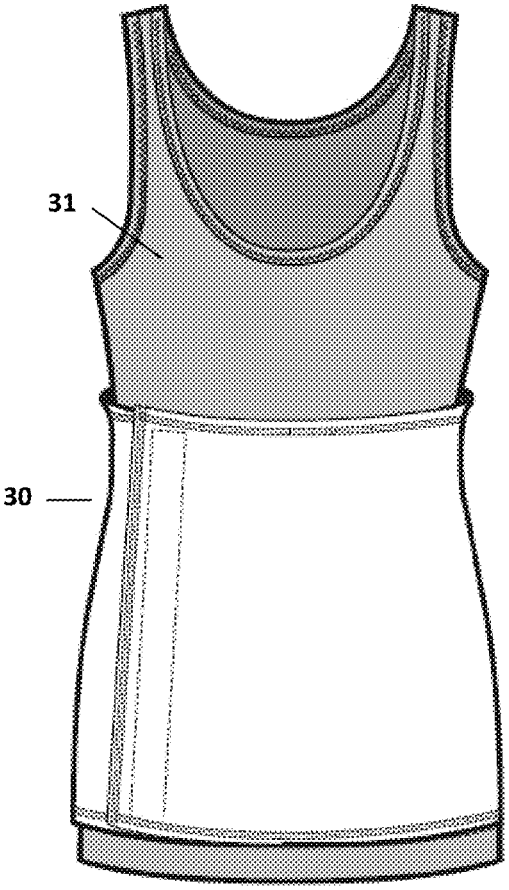
FIG. 17 is a Front elevation view of the Women's Active Wear Exercise Top with the abdomen Wrap closed around the waist, according to the sixth embodiment.

FIG. 17 is a Front elevation view of the Women's Active Wear Exercise Top with the abdomen Wrap closed around the waist, according to the sixth embodiment.

Element 30 is a Front elevation view of the Top with the Wrap closed and Velcro patch closure. The Wrap is constructed with a four way multi-functional fabric, such as neoprene or similar fabric.

Element 31 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 18:
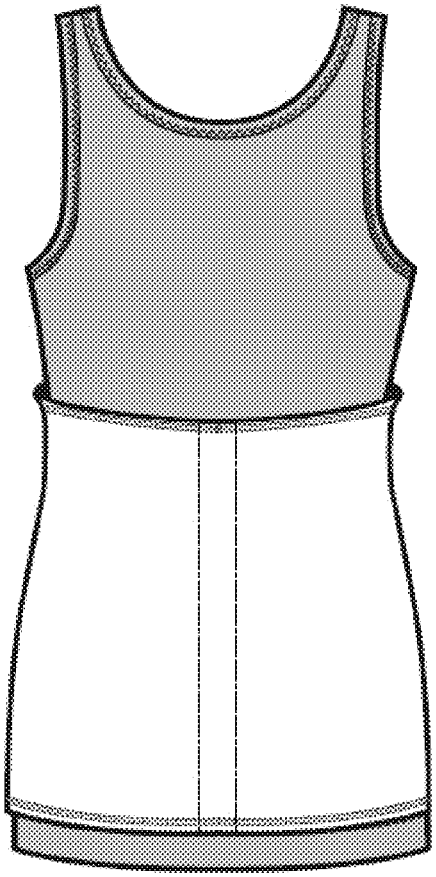
FIG. 18 is a Rear elevation view thereof, according to an embodiment.

FIG. 18 is a Rear elevation view thereof.

Figure 19:
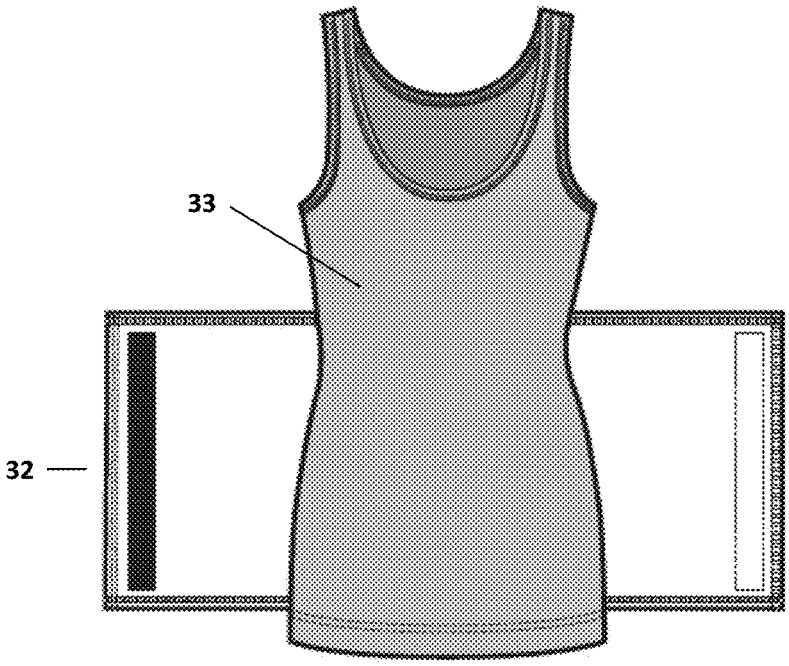
FIG. 19 is a Front elevation view of the Women's Active Wear Exercise Top with the abdomen Wrap open around the waist according to an embodiment.

FIG. 19 is a Front elevation view of the Women's Active Wear Exercise Top with the abdomen Wrap open around the waist.

Element 32 is a Front elevation view of the Velcro patches which keeps the Wrap closed and in place. The Velcro patches are on the right and left sides of the Wrap.

Element 33 is a Front elevation of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 20:
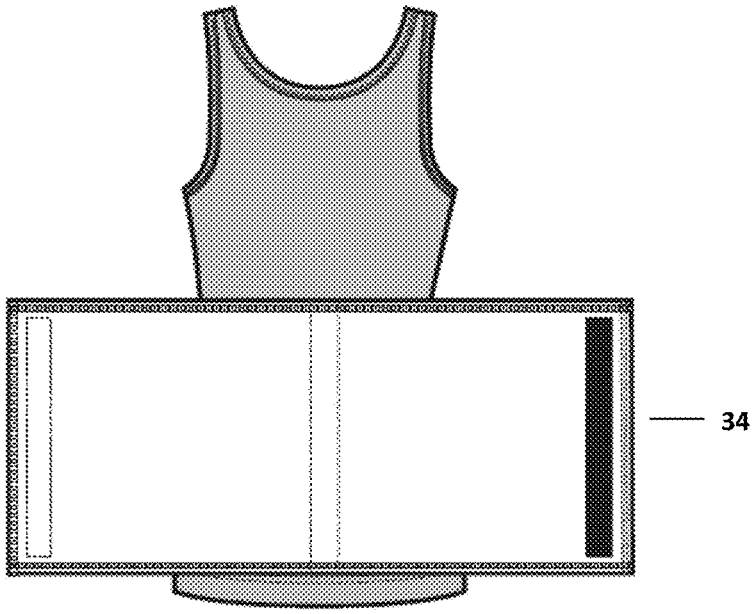
FIG. 20 is a Rear elevation view thereof, according to an embodiment.

FIG. 20 is a Rear elevation view thereof.

Element 34 is a Rear elevation view of the Velcro patches which keeps the Wrap closed and in place. The Velcro patches are on the right side, left side, and middle of the Wrap.

Figure 21:
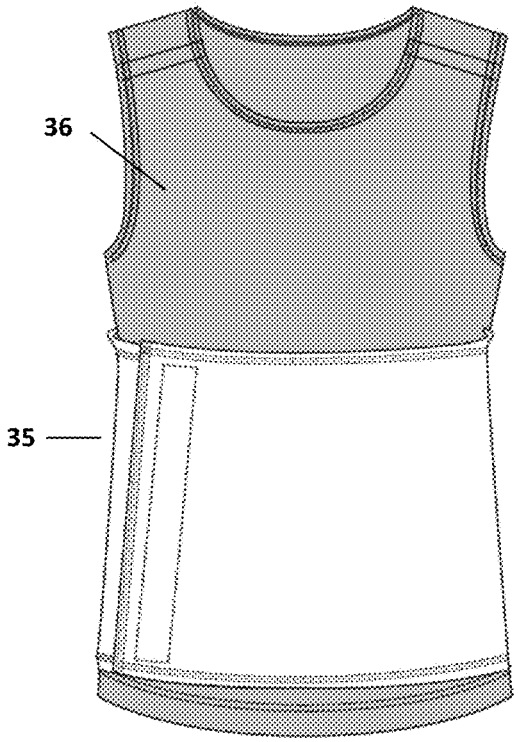
FIG. 21 is a Front elevation view of the Men's Active Wear Exercise Top with the abdomen Wrap closed around the waist, according to the seventh embodiment.

FIG. 21 is a Front elevation view of the Men's Active Wear Exercise Top with the abdomen Wrap closed around the waist, according to the seventh embodiment.

Element 35 is a Front elevation view of the Top with the Wrap closed and Velcro patch closure. The Wrap is constructed with a four way multi-functional fabric, such as neoprene or similar fabric.

Element 36 is a Front view elevation of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 22:
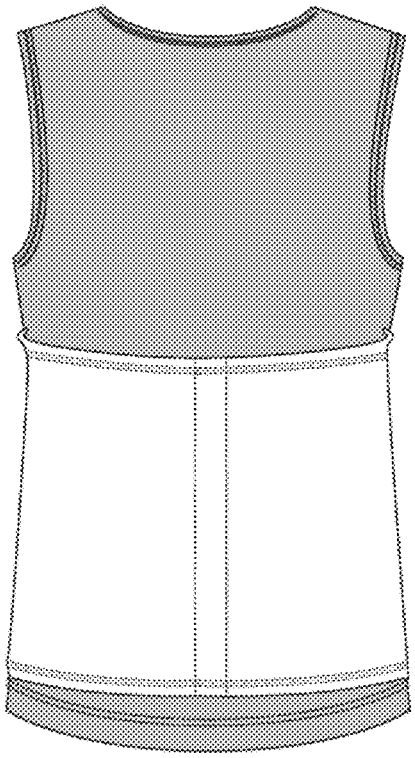
FIG. 22 is a Rear elevation view thereof, according to an embodiment.

FIG. 22 is a Rear elevation view thereof.

Figure 23:
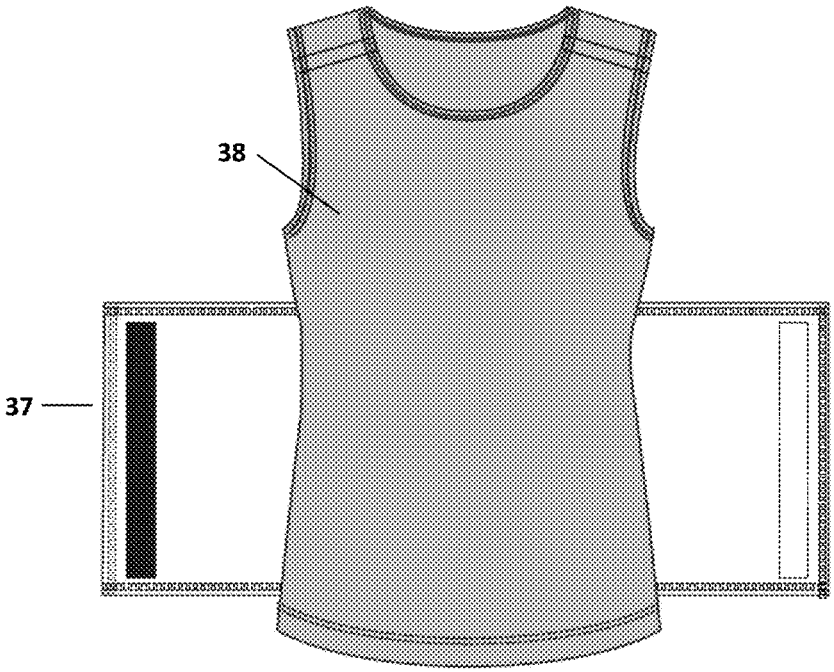
FIG. 23 is a Front elevation view of the Men's Active Wear Exercise Top with the Wrap open around the waist, according to an embodiment.

FIG. 23 is a Front elevation view of the Men's Active Wear Exercise Top with the Wrap open around the waist.

Element 37 is a Front elevation view of the Velcro patches which keeps the Wrap closed and in place. The Velcro patches are on the right and left sides of the Wrap.

Element 38 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 24:
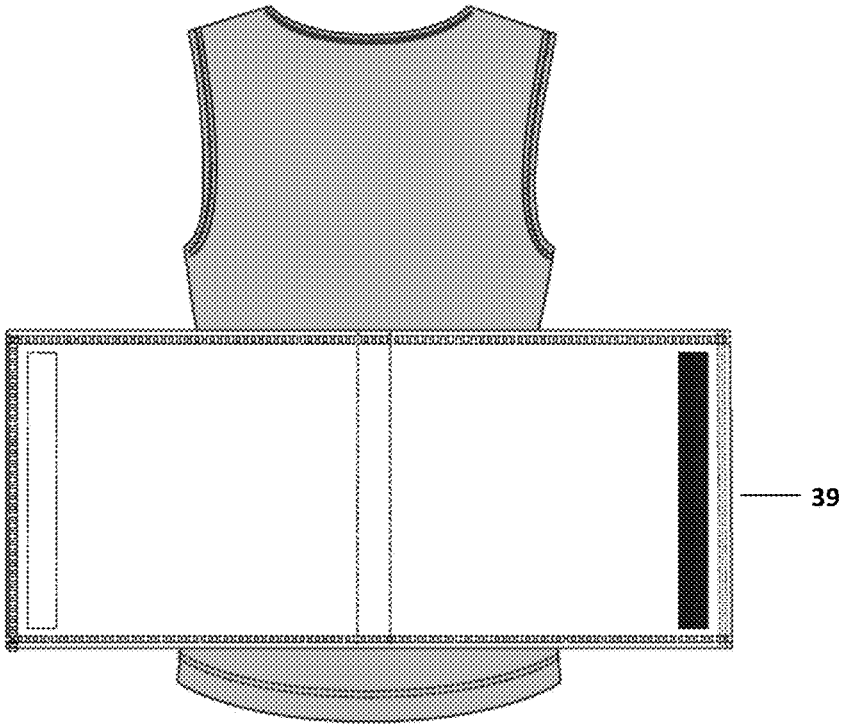
FIG. 24 is a Rear elevation view thereof, according to an embodiment.

FIG. 24 is a Rear elevation view thereof.

Element 39 is a Rear elevation view of the Velcro patches which keeps the Wrap closed and in place. The Velcro patches are on the right side, left side, and middle of the Wrap.

Figure 25:
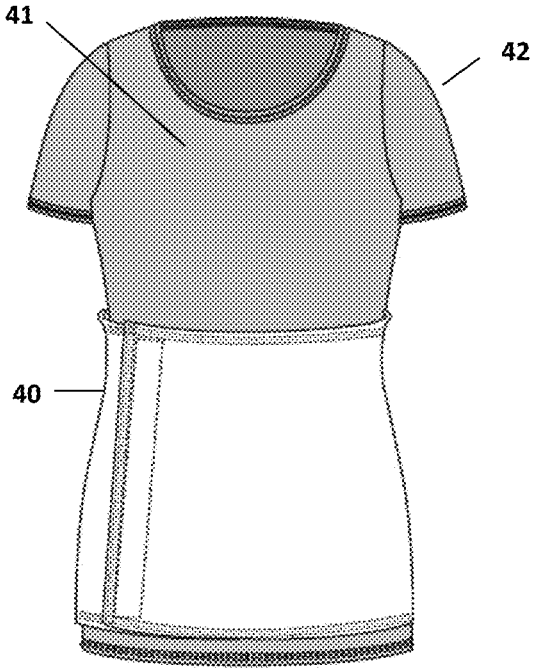
FIG. 25 is a Front elevation view of the Women's Active Wear Exercise Top with Sleeves and abdomen Wrap closed around the waist, according to the eighth embodiment.

FIG. 25 is a Front elevation view of the Women's Active Wear Exercise Top with Sleeves and abdomen Wrap closed around the waist, according to the eighth embodiment.

Element 40 is a Front elevation view of the Top with the Wrap closed and Velcro patch closure. The Wrap is constructed with a four way multi-functional fabric, such as neoprene or similar fabric.

Element 41 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Element 42 is a Front elevation view of sleeves thereof.

Figure 26:
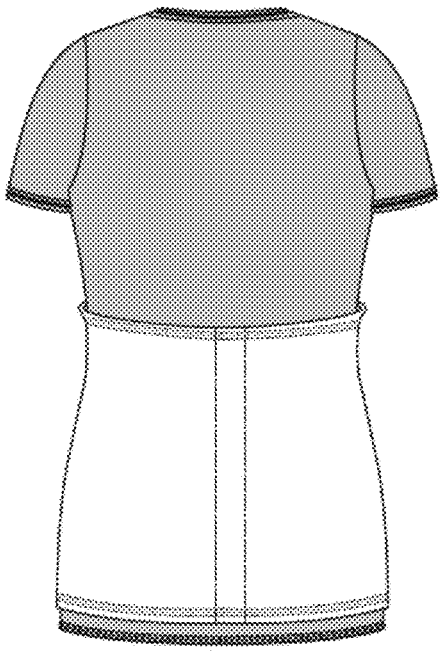
FIG. 26 is a Rear elevation view thereof, according to an embodiment.

FIG. 26 is a Rear elevation view thereof.

Figure 27:
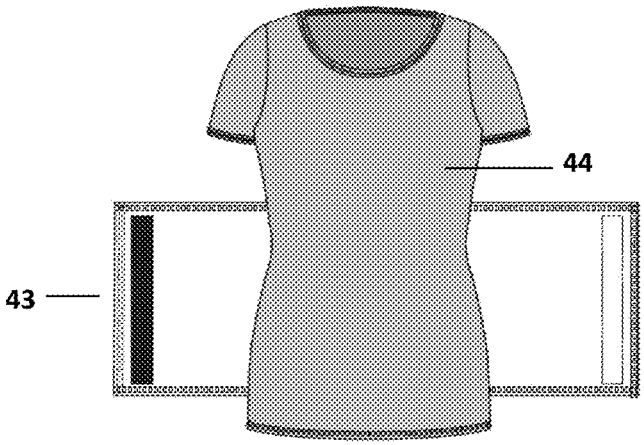
FIG. 27 is a Front elevation view of the Women's Active Wear Exercise Top with Sleeves and the Wrap open around the waist, according to an embodiment.

FIG. 27 is a Front elevation view of the Women's Active Wear Exercise Top with Sleeves and the Wrap open around the waist.

Element 43 is a Front elevation view of the Velcro patches which keeps the Wrap closed and in place. The Velcro patches are on the right and left sides of the Wrap.

Element 44 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 28:
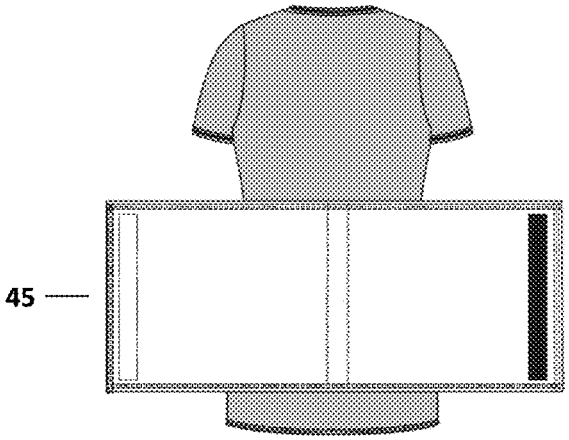
FIG. 28 is a Rear elevation view thereof, according to an embodiment.

FIG. 28 is a Rear elevation view thereof.

Element 45 is a Rear elevation view of the Velcro patches which keeps the Wrap closed and in place. The Velcro patches are on the right side, left side, and middle of the Wrap.

Figure 29:
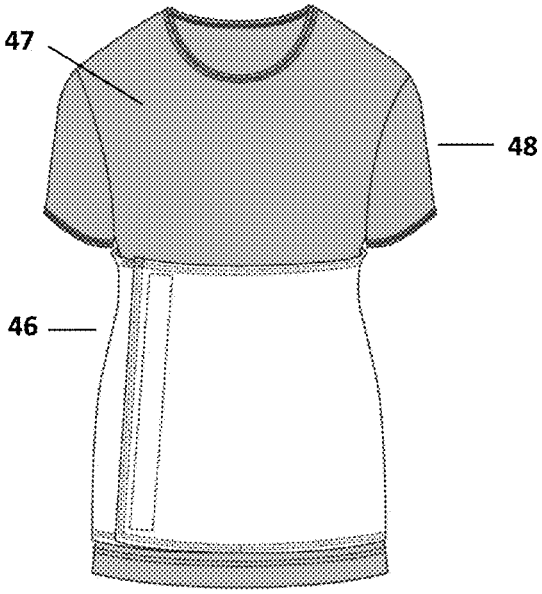
FIG. 29 is a Front elevation view of the Men's Active Wear Exercise Top with Sleeves and the abdomen Wrap closed around the waist, according to the ninth embodiment.

FIG. 29 is a Front elevation view of the Men's Active Wear Exercise Top with Sleeves and the abdomen Wrap closed around the waist, according to the ninth embodiment.

Element 46 is a Front elevation view of the Top with the Wrap closed and Velcro patch closure. The Wrap is constructed with a four way multi-functional fabric, such as neoprene or similar fabric.

Element 47 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Element 48 is a Front elevation view of sleeves thereof.

Figure 30:
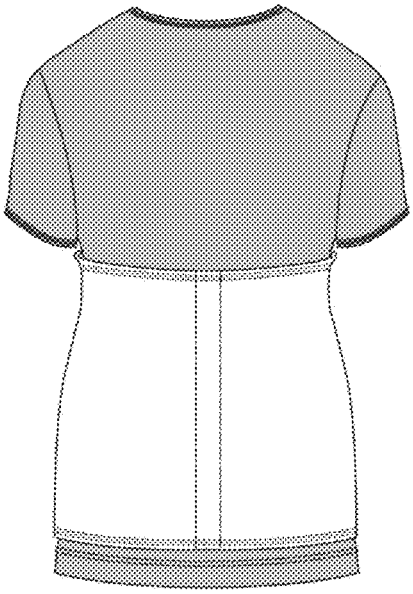
FIG. 30 is a Rear elevation view thereof, according to an embodiment.

FIG. 30 is a Rear elevation view thereof.

Figure 31:
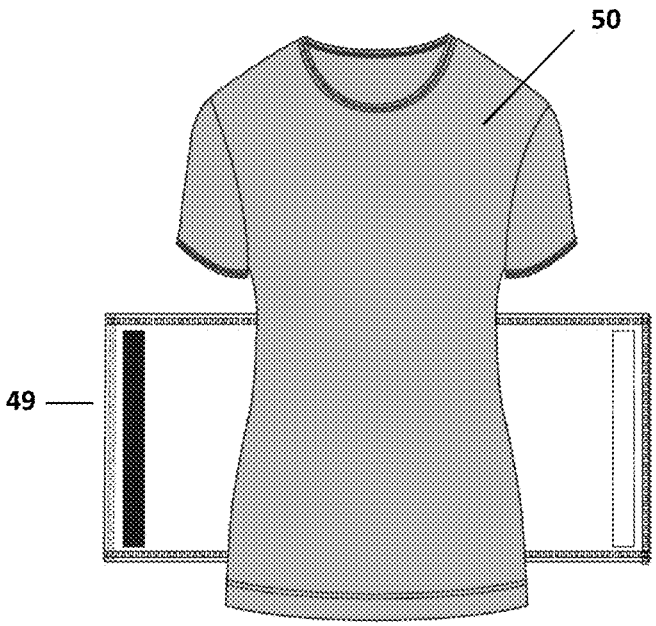
FIG. 31 is a Front elevation view of the Men's Active Wear Exercise Top with Sleeves and the abdomen Wrap open around the waist, according to an embodiment.

FIG. 31 is a Front elevation view of the Men's Active Wear Exercise Top with Sleeves and the abdomen Wrap open around the waist.

Element 49 is a Front elevation view of the Velcro patches which keeps the Wrap closed and in place. The Velcro patches are on the right and left sides of the Wrap.

Element 50 is a Front elevation view of the Top under the Wrap. The Top is constructed with fabric that has a plurality of densities with integrated elasticity, such as LYCRA®, spandex, or knit fabric, or four way multi-functional fabric, such as neoprene or similar fabric. The Top's length extends to the mid hip section of the wearer (length will vary) thereof.

Figure 32:
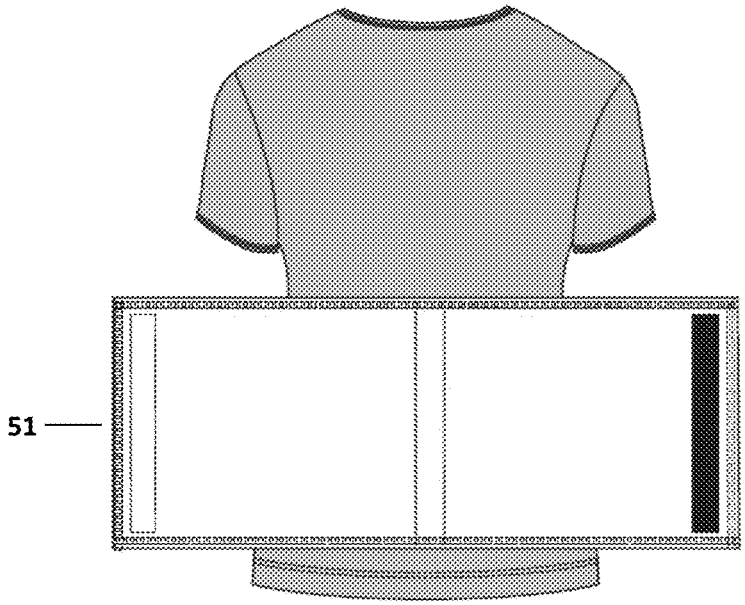
FIG. 32 is a Rear elevation view thereof, according to an embodiment.

FIG. 32 is a Rear elevation view thereof.

Element 51 is a Rear elevation view of the Velcro patches which keeps the Wrap closed and in place. The Velcro patches are on the right side, left side, and middle of the Wrap.

Figure 33:
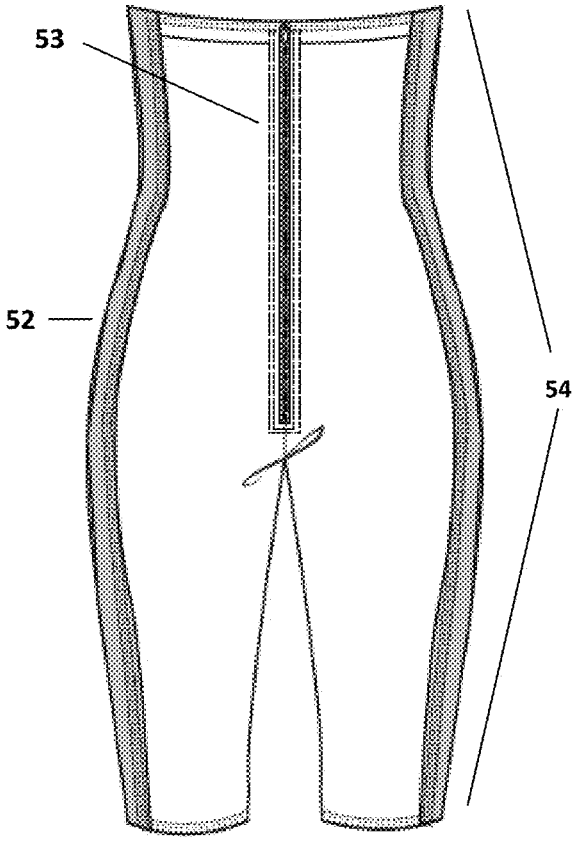
FIG. 33 is a Front elevation view of the Active Wear Exercise Pant, according to the tenth embodiment.

FIG. 33 is a Front elevation view of the Active Wear Exercise Pant, according to the tenth embodiment.

Element 52 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 55. The Side Panels are constructed with fabric that has a plurality of densities with integrated elasticity, such as LYCRA®, spandex, or knit fabric.

Element 53 is a Front elevation view of the Zipper in the middle of the Pant.

Element 54 is a Front elevation view of the front Pant panels which extends from under the breast and chest, covers the abdomen area, thighs, and legs. The length of the Pant will vary. The front Pant panels are constructed with a four way multi-functional fabric; such as neoprene or similar fabric.

Figure 34:
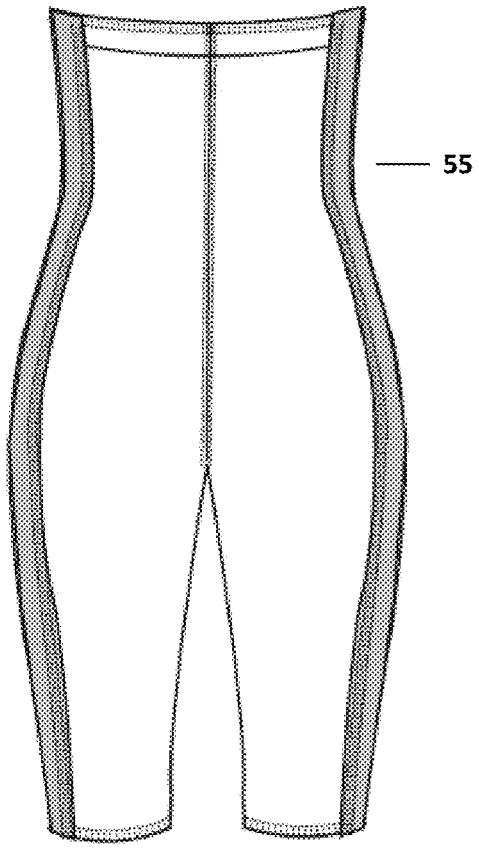
FIG. 34 is a Rear elevation view of the back Pant panels which extends from the mid back, and covers the hips, thighs and legs, according to an embodiment.

FIG. 34 is a Rear elevation view of the back Pant panels which extends from the mid back, and covers the hips, thighs and legs. The length of the Pant will vary. The back Pant panels are constructed with a four way multi-functional fabric, such as neoprene or similar fabric.

Element 55 is a Rear elevation view of the Side Panels thereof.

Element 56 is a Side elevation view of the Side Panels thereof.

Figure 35:
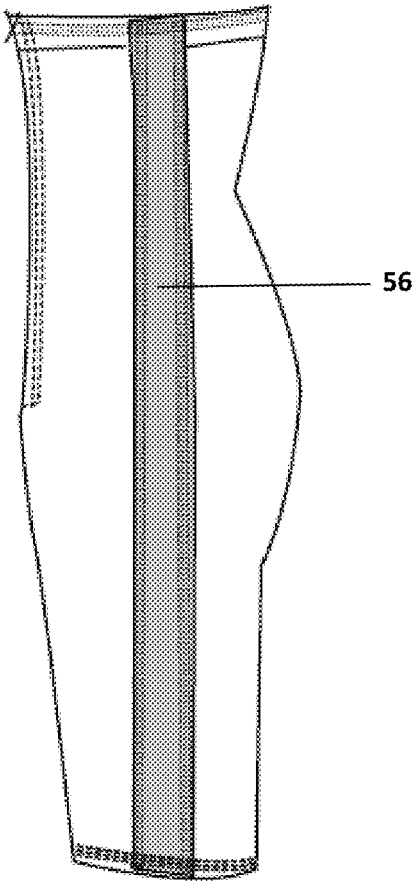
FIG. 35 is a Side elevation View of the Pant thereof, according to an embodiment.

FIG. 35 is a Side elevation View of the Pant thereof.

Figure 36:
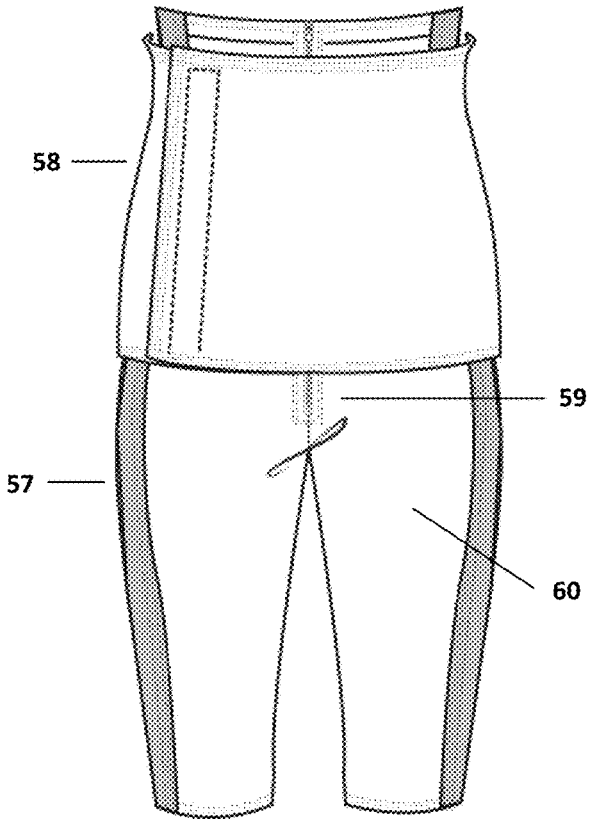
FIG. 36 is a Front elevation view of the Active Wear Exercise Pant with the abdomen Wrap closed around the waist, according to the, eleventh embodiment.

FIG. 36 is a Front elevation view of the Active Wear Exercise Pant with the abdomen Wrap closed around the waist, according to the, eleventh embodiment.

Element 57 is a Front elevation view of the Side Panel; thereof; the side panels are inserted to connect the front and back of the garment. Each Side Panel is approximately 4 to 6 inches in width. About 2 to 3 inches of each side pane! is soon in the front view and, about 2 to 3 inches of each side panel as seen in the back view of the garment as in Element 61. The Side Panels are constructed with fabric that has a plurality of densities with integrated elasticity, such as LYCRA®, spandex, or knit fabric.

Element 58 is a Front elevation view of the Pant with the Wrap dosed around the waist and Velcro patch front closure. The Wrap covers the abdomen area. The Wrap is constructed with a four way multi-functional fabric, such as neoprene or similar fabric.

Element 59 is a Front elevation view of the Zipper in the middle of the Pant under the Wrap. Element 60 is a Front elevation view of the Pant under the Wrap. The front Pant panels extends from under the breast and chest, covers the abdomen area, thighs, and legs. The length of the Pant will vary. The front Pant panels are constructed with a four way multi-functional fabric, such as neoprene or similar fabric.

Figure 37:
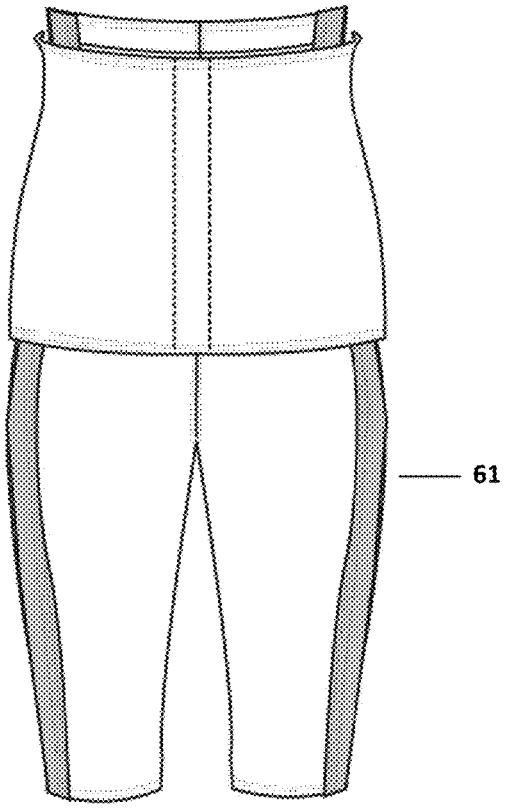
FIG. 37 is a Rear elevation view of the back Pant panels which extends from the mid back, and covers the hips, thighs, and legs, according to an embodiment.

FIG. 37 is a Rear elevation view of the back Pant panels which extends from the mid back, and covers the hips, thighs, and legs. The length of the Pant will vary. The back Pant panels are constructed with a four way multi-functional fabric, such as neoprene or similar fabric.

Element 61 is a Rear elevation view of the Side Panels thereof.

Figure 38:
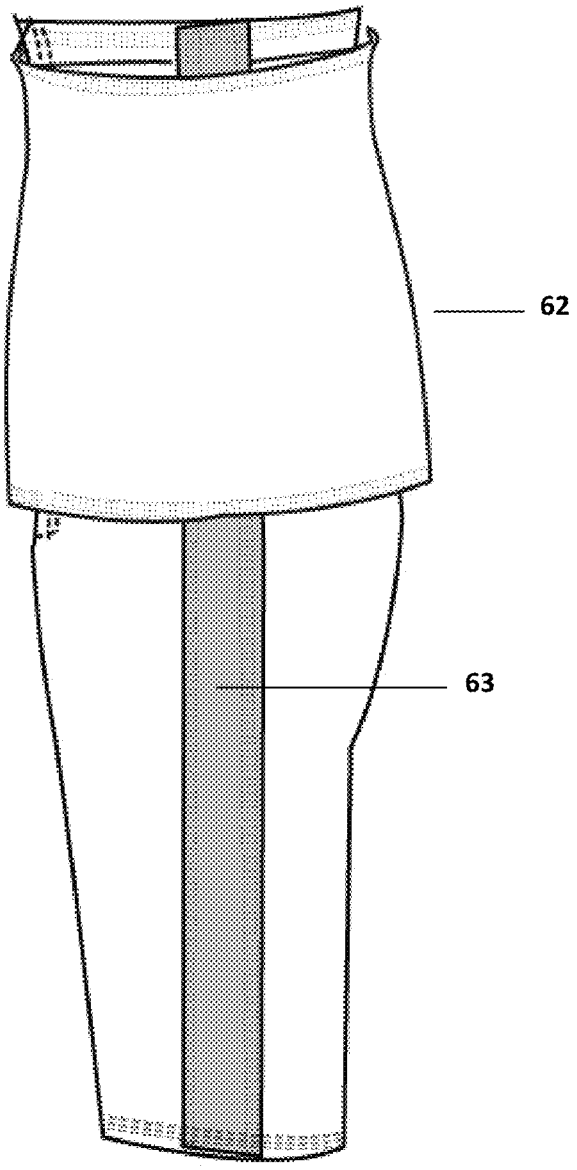
FIG. 38 is a Side elevation view of the Pant with the Wrap thereof, according to an embodiment.

FIG. 38 is a Side elevation view of the Pant with the Wrap thereof.

Element 62 is a Side elevation view of the Wrap thereof.

Element 63 is a Side elevation view of the Side Panels thereof.

Figure 39:
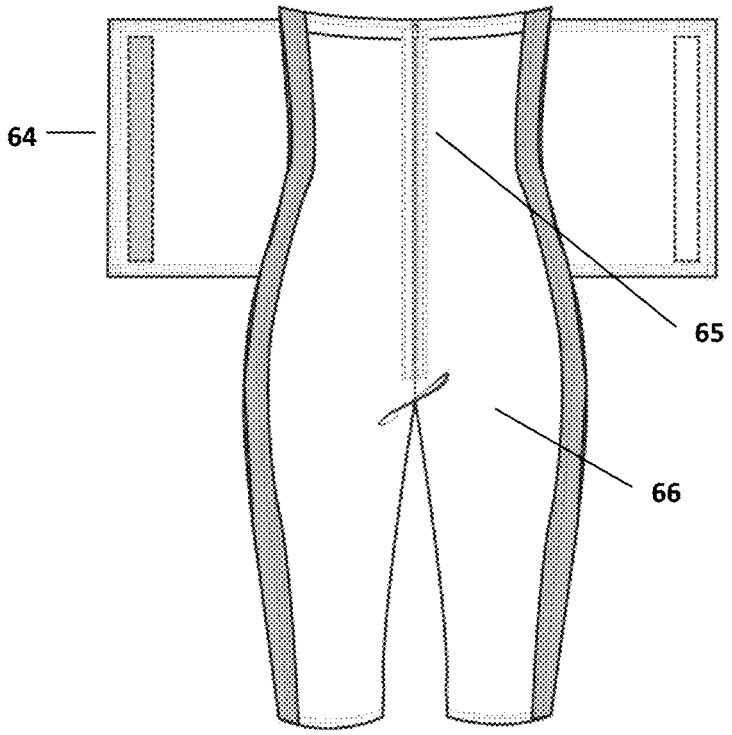
FIG. 39 is a Front elevation view the Active Wear Exercise Pant with the Wrap open around the waist, according to an embodiment.

FIG. 39 is a Front elevation view the Active Wear Exercise Pant with the Wrap open around the waist.

Element 64 is a Front elevation view of the Velcro patches which keeps the Wrap closed and in place. The Velcro patches are on the right and left sides of the Wrap thereof.

Element 65 is a Front elevation view of the Zipper in the middle of the Pant thereof.

Element 66 is a Front elevation view of the Pant under the Wrap and the front Pant panels which extends from under the breast and chest, covers the abdomen area, thighs, and legs. The length of the Pant will vary. The front Pant panels are constructed with a four way multi-functional fabric, such as neoprene or similar fabric.

Figure 40:
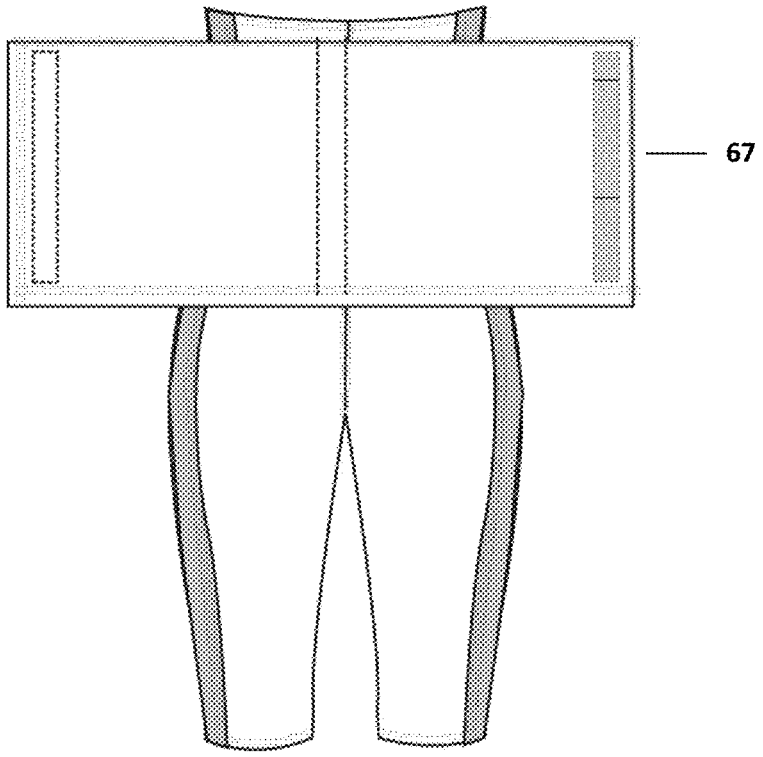
FIG. 40 is a Rear elevation view thereof, according to an embodiment.

FIG. 40 is a Rear elevation view thereof.

Element 67 is a Rear elevation view of the Velcro patches which keeps the Wrap closed and in place. The Velcro patches are on the right side, left side, and middle of the Wrap.

Figure 41:
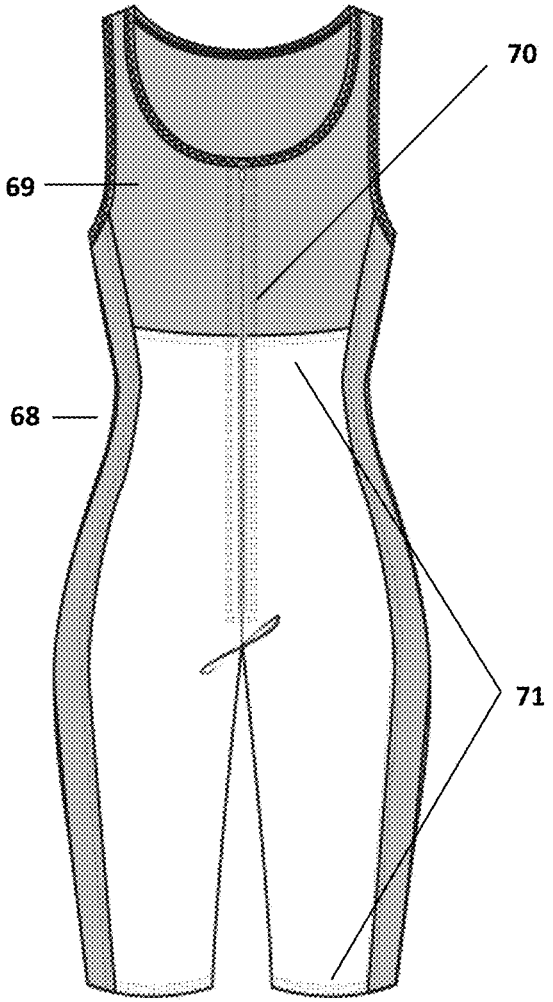
FIG. 41 is a Front elevation view of the Active Wear Exercise All in One Suit for men and women, according to the twelfth embodiment.

FIG. 41 is a Front elevation view of the Active Wear Exercise All in One Suit for men and women, according to the twelfth embodiment.

Element 68 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 72. The Side Panels are constructed with fabric that has a plurality of densities with integrated elasticity, such as LYCRA®, spandex, or knit fabric.

Element 69 is a Front elevation view of the Top Section which supports the breast chest area and is constructed with fabric that has a plurality of densities with integrated elasticity, such as LYCRA®, spandex, or knit fabric thereof.

Element 70 is a Front elevation view of the middle Zipper from the Top section to the crotch of the pants section thereof.

Element 71 is a Front elevation view of the front Pant panels which extends from under the breast and chest, covers the abdomen area, thighs, and legs. The length of the Pant will vary. The front Pant panels are constructed with a four way multi-functional fabric, such as neoprene or similar fabric.

Figure 42:
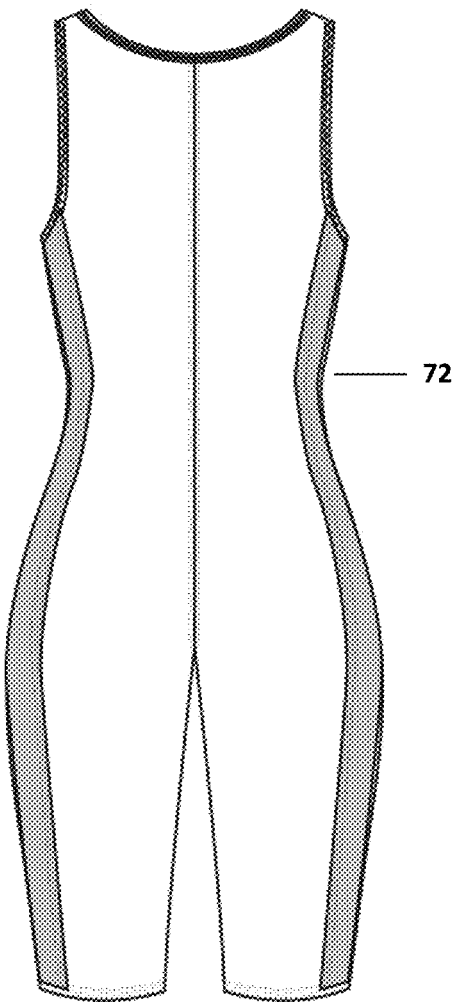
FIG. 42 is a Rear elevation view of Side Panels, according to an embodiment.

FIG. 42 is a Rear elevation view of the back panels which extends from the Top of the All in One Suit to the bottom of the pant. The length of the Pant will vary. The back panels are constructed with a four way multi-functional fabric, such as neoprene or similar fabric.

Element 72 is a Rear elevation view of the Side Panels thereof.

Element 73 is a Side elevation view of the Side Panels thereof.

Figure 43:
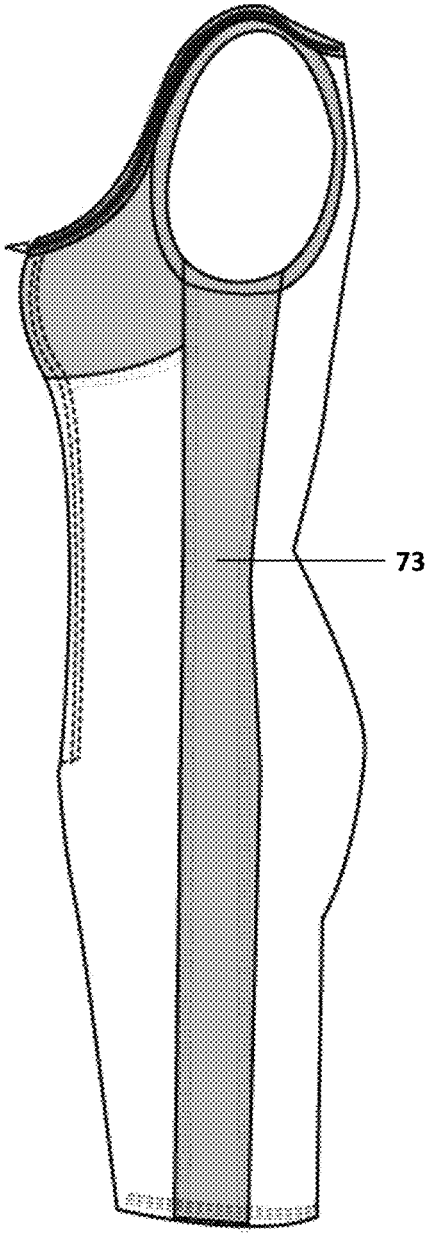
FIG. 43 is a Side elevation view of Side Panels, according to an embodiment.

FIG. 43 is a Side elevation view of the All In One Suit thereof.

Figure 44:
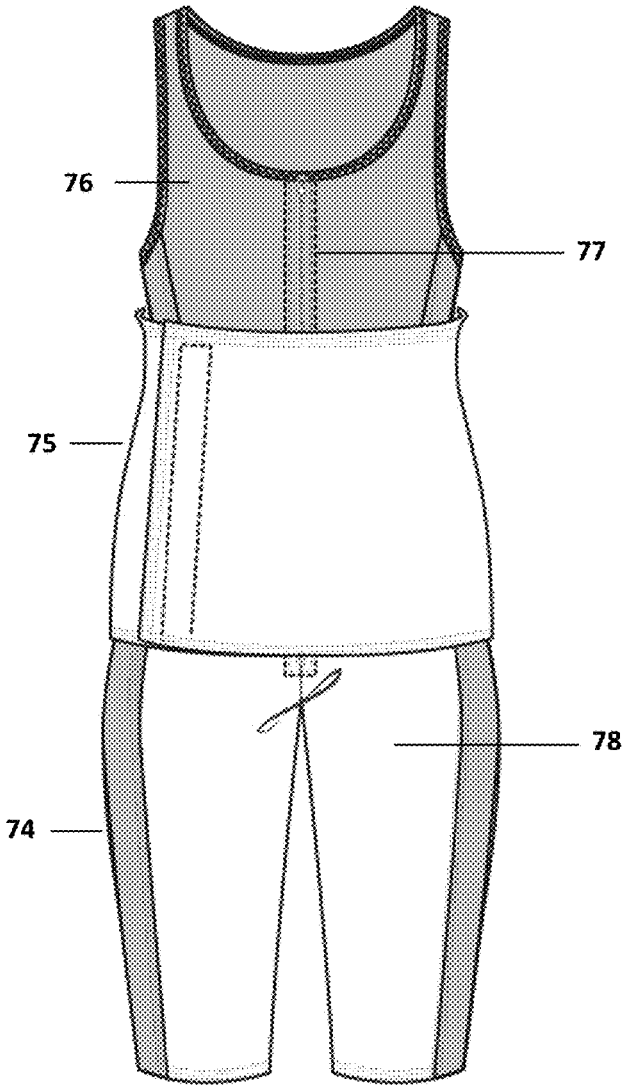
FIG. 44 is a Front elevation view of the Active Wear Exercise All in One Suit for men and women with the abdomen Wrap closed around the waist, according to the thirteenth embodiment.

FIG. 44 is a Front elevation view of the Active Wear Exercise All in One Suit for men and women with the abdomen Wrap closed around the waist, according to the thirteenth embodiment.

Element 74 is a Front elevation view of the Side Panels thereof; the side panels are inserted to connect the front and back of the garment. Each Side Panel is approximately 4 to 6 inches in width. About 2 to 3 inches of each side panel is seen in the front view and, about 2 to 3 inches of each side panel as seen in the back view of the garment as in Element 79. The Side Panels are constructed with fabric that has a plurality of densities with integrated elasticity, such as LYCRA®, spandex, or knit fabric Element 75 is a Front elevation view of the All in One Suit with the Wrap closed around the waist and Velcro patch closure. The Wrap covers the abdomen area. The Wrap is constructed with a four way multi-functional fabric, such as neoprene or similar fabric.

Element 76 is a Front elevation of the Top Section which supports the breast chest area and is constructed with fabric that has a plurality of densities with integrated elasticity, such as LYCRA®, spandex, or knit fabric thereof.

Element 77 is a Front elevation view of the front Zipper under the Wrap from the top section to the crotch of the pants section thereof.

Element 78 is a Front elevation view of the front Pant panels which extends from under the breast and chest, covers the abdomen area, thighs, and legs. The length of the Pant will vary. The front Pant panels are constructed with a four way multi-functional fabric, such as neoprene or similar fabric.

Figure 45:
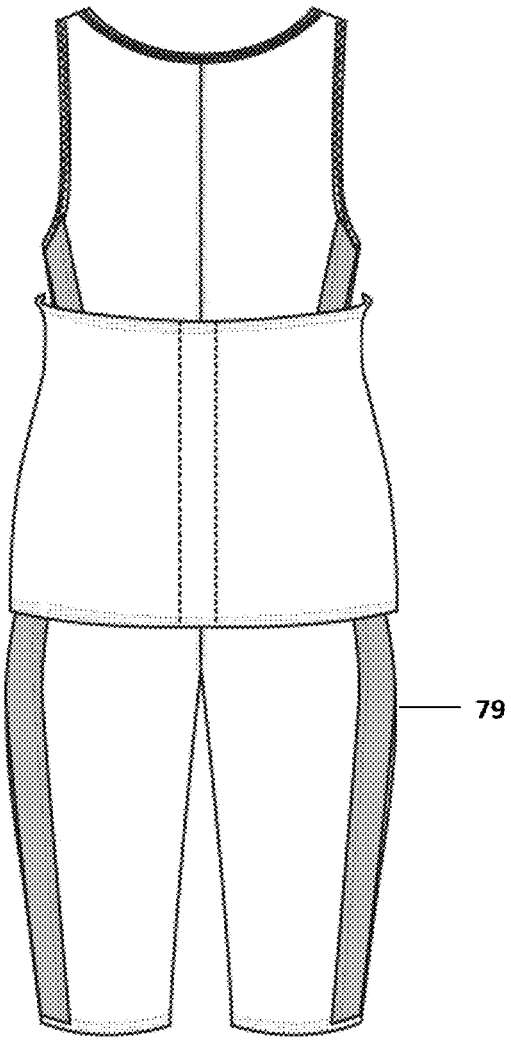
FIG. 45 is a Rear elevation view of the back panels which extends from the top of the All in One Suit to the bottom, according to an embodiment.

FIG. 45 is a Rear elevation view of the back panels which extends from the top of the All in One Suit to the bottom of the pant. The length of the Pant will vary. The back panels are constructed with a four way multi-functional fabric, such as neoprene or similar fabric.

Element 79 is a Rear elevation view of the Side Panels thereof.

Element 80 is a Side elevation view of the Wrap thereof.

Element 81 is a Side elevation view of the Side Panels thereof.

Figure 46:
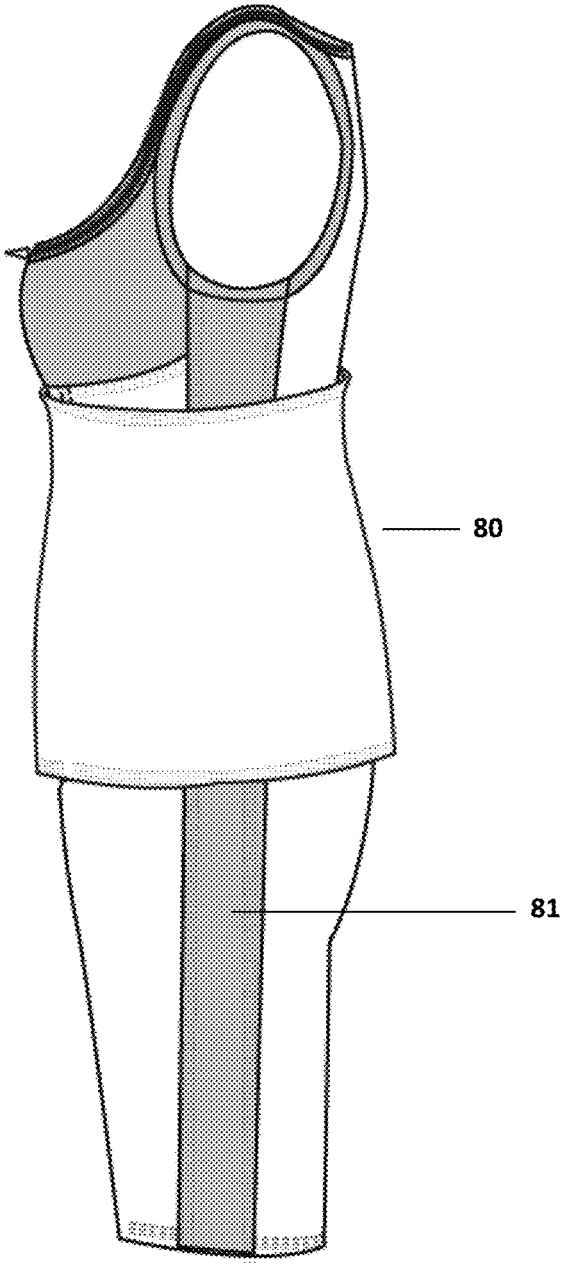
FIG. 46 is a Side elevation view of the All In One Suit thereof, according to an embodiment.

FIG. 46 is a Side elevation view of the All In One Suit thereof.

Figure 47:
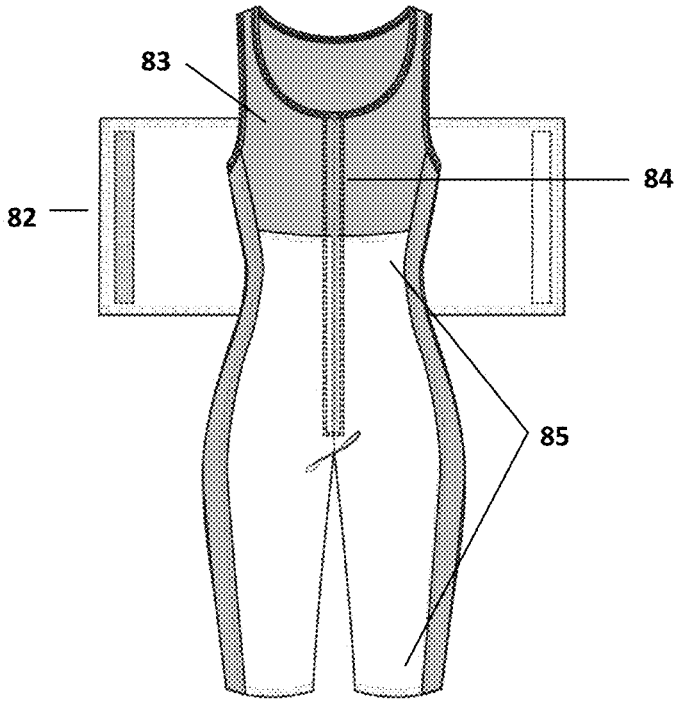
FIG. 47 is a Front elevation view of the Active Wear Exercise All in One Suit for men and women with the Wrap open around the waist, according to an embodiment.

FIG. 47 is a Front elevation view of the Active Wear Exercise All in One Suit for men and women with the Wrap open around the waist.

Element 82 is a Front elevation view of the Velcro patches which keeps the Wrap closed and in place. The Velcro patches are on the right and left sides of the Wrap thereof.

Element 83 is a Front elevation view of the Top Section which supports the breast chest area and is constructed with fabric that has a plurality of densities with integrated elasticity, such as LYCRA®, spandex, or knit fabric thereof.

Element 84 is a Front elevation view of the middle Zipper from the Top section to the crotch of the pants section thereof.

Element 85 is a Front elevation view of the front Pant panels which extends from under the breast and chest, covers the abdomen area, thighs, and legs. The length of the Pant will vary. The front Pant panels are constructed with a four way multi-functional fabric, such as neoprene or similar fabric.

Figure 48:
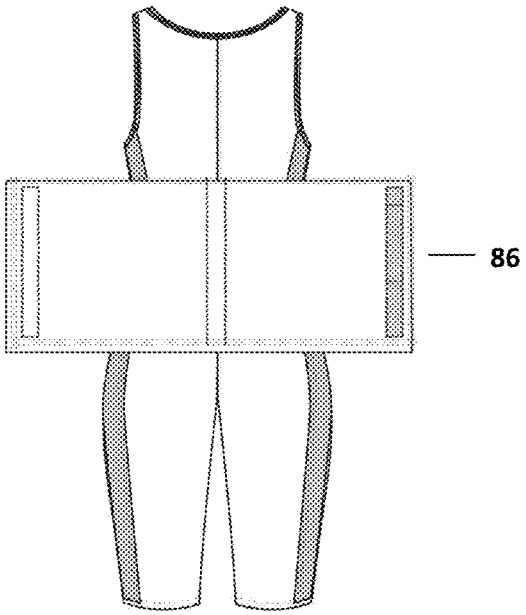
FIG. 48 is a Rear elevation view of the back panels which extends from the Top of the All in One Suit to the bottom of the pant, according to an embodiment.

FIG. 48 is a Rear elevation view of the back panels which extends from the Top of the All in One Suit to the bottom of the pant. The length of the Pant will vary. The back panels are constructed with a four way multi-functional fabric, such as neoprene or similar fabric.

Element 86 is a Rear elevation view of the Side Panels thereof.

I claim:

1. An active wear exercise garment comprising:

a top comprising:

a front panel comprising:

a first upper section having dimensions configured to cover a user's chest area, the first upper section fabricated from a first material comprising spandex arranged to promote stretching; and a second lower section having dimensions configured to cover a user's abdomen, the second lower section fabricated from a second material comprising neoprene arranged to promote water weight loss, wherein the first material and the second material are different materials;

a rear panel fabricated from a third material comprising neoprene arranged to promote water weight loss; and at least a first side panel connecting a first side edge of the front panel and a first side edge of the rear panel, the first side panel having an upper limit coinciding with an arm hole and extending to a bottom of the second lower section, wherein the first side panel is fabricated from a fourth material comprising spandex arranged to promote stretching of the top through the first side panel and minimizing stretching through the second lower section and the rear panel; and a wrap having dimensions configured to removably be positioned around a user's abdomen, wherein the top and the wrap are configured to engage with a user in a form-fitting manner.

2. The active wear exercise garment of claim 1, wherein the first material comprising spandex is configured to provide ventilation.

3. The active wear exercise garment of claim 1, wherein the fourth material comprising spandex is configured to provide ventilation.

4. The active wear exercise garment of claim 1, wherein the first material and the fourth material are the same type of material.

5. The active wear exercise garment of claim 1, wherein the second material comprising neoprene is a breathable neoprene.

6. The active wear exercise garment of claim 1, wherein the second material comprising neoprene is a non-breathable neoprene.

7. The active wear exercise garment of claim 1, wherein the third material comprising neoprene is a breathable neoprene.

8. The active wear exercise garment of claim 1, wherein the third material comprising neoprene is a non-breathable neoprene.

9. The active wear exercise garment of claim 1, further comprising:

a second side panel opposite the first side panel and connecting the front panel and the rear panel and extending from an under arm section to a bottom of the second lower section, wherein the second side panel is fabricated from a fifth material comprising spandex arranged to promote stretching of the top through the first side panel and minimizing stretching through the second lower section and the rear panel.

10. The active wear exercise garment of claim 9, wherein the fifth material and the fourth material are the same type of material.

11. The active wear exercise garment of claim 1, wherein the wrap is fabricated from a material comprising neoprene.

12. The active wear exercise garment of claim 1, wherein the neoprene is a breathable neoprene.

13. The active wear exercise garment of claim 1, wherein the neoprene is a non-breathable neoprene.

14. The active wear exercise garment of claim 1, wherein the wrap includes two ends, each end with a fastener for attaching the two ends together.

15. The active wear exercise garment of claim 14, wherein the fastener is a hook and a loop.

* * * * *